US006382765B1

(12) United States Patent
Kanda et al.

(10) Patent No.: US 6,382,765 B1
(45) Date of Patent: May 7, 2002

(54) INK-JET PRINTING APPARATUS AND DISCHARGE RECOVERY METHOD THEREFOR

(75) Inventors: Hidehiko Kanda, Kawasaki; Toshiharu Inui, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/426,880

(22) Filed: Oct. 26, 1999

(30) Foreign Application Priority Data

Oct. 27, 1998 (JP) ..... 10-306066

(51) Int. Cl.[7] ..... B41J 2/165
(52) U.S. Cl. ..... 347/23; 347/29; 347/92
(58) Field of Search ..... 347/23, 19, 29, 347/32, 24, 30, 14, 92, 35

(56) References Cited

U.S. PATENT DOCUMENTS 5,475,404 A * 12/1995 Takahashi et al. ..... 347/23
5,495,271 A * 2/1996 Koitabashi et al. ..... 347/23
5,805,182 A * 9/1998 Lee ..... 347/35
6,174,038 B1 * 1/2001 Nakazawa et al. ..... 347/10
6,231,156 B1 * 5/2001 Ono ..... 347/24

FOREIGN PATENT DOCUMENTS

EP 0 694 403 * 1/1996
JP 4-219253 8/1992

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

A printing apparatus which prevents discharge failure due to residual bubbles generated in accordance with a printing history of past printing such as the number of printing pulses, the printing and the printing area, and a precipitate from ink, in each ink type, and/or due to residual bubbles coalesced into larger bubbles after the completion of printing and a precipitate from ink, and which enables excellent image printing without unnecessarily increasing ink consumption and without reduction of the printing speed. A CPU 600 measures a driving state of a printhead per unit period, e.g., the number of driving pulses to all the discharge orifices and the driving interval of the printhead. When the printing has been completed, the CPU calculates the number of driving pulses per unit period, and if the calculated value is greater than an allowable value, it performs discharge recovery processing on the printhead.

20 Claims, 16 Drawing Sheets

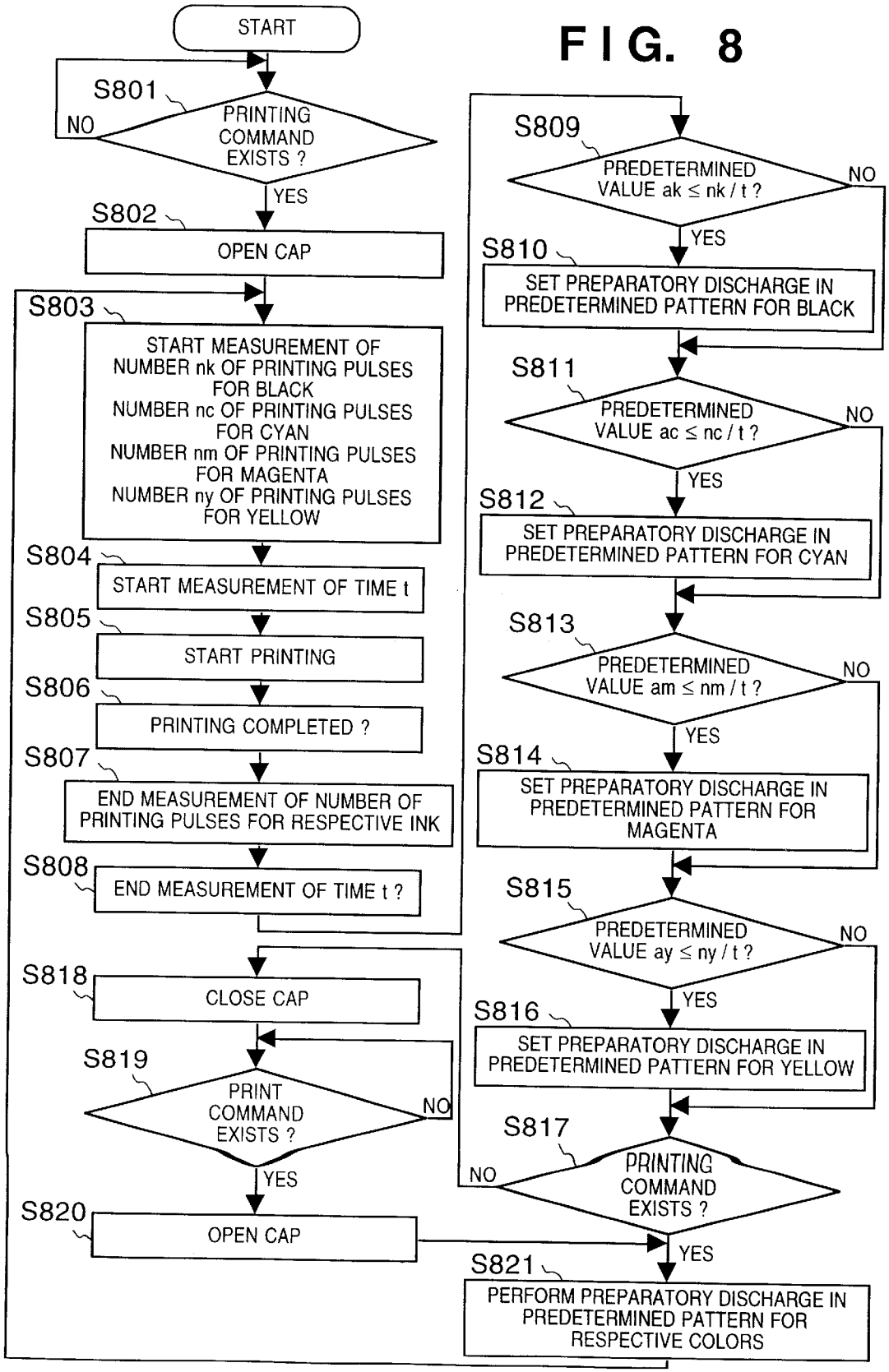
FIG. 8
START
S801
PRINTING COMMAND EXISTS ?
NO
YES
S802
OPEN CAP
S803
START MEASUREMENT OF NUMBER nk OF PRINTING PULSES FOR BLACK
NUMBER nc OF PRINTING PULSES FOR CYAN
NUMBER nm OF PRINTING PULSES FOR MAGENTA
NUMBER ny OF PRINTING PULSES FOR YELLOW
S804
START MEASUREMENT OF TIME t
S805
START PRINTING
S806
PRINTING COMPLETED ?
S807
END MEASUREMENT OF NUMBER OF PRINTING PULSES FOR RESPECTIVE INK
S808
END MEASUREMENT OF TIME t ?
S809
PREDETERMINED VALUE ak ≤ nk / t ?
NO
YES
S810
SET PREPARATORY DISCHARGE IN PREDETERMINED PATTERN FOR BLACK
S811
PREDETERMINED VALUE ac ≤ nc / t ?
NO
YES
S812
SET PREPARATORY DISCHARGE IN PREDETERMINED PATTERN FOR CYAN
S813
PREDETERMINED VALUE am ≤ nm / t ?
NO
YES
S814
SET PREPARATORY DISCHARGE IN PREDETERMINED PATTERN FOR MAGENTA
S815
PREDETERMINED VALUE ay ≤ ny / t ?
NO
YES
S816
SET PREPARATORY DISCHARGE IN PREDETERMINED PATTERN FOR YELLOW
S817
PRINTING COMMAND EXISTS ?
NO
YES
S818
CLOSE CAP
S819
PRINT COMMAND EXISTS ?
NO
YES
S820
OPEN CAP
S821
PERFORM PREPARATORY DISCHARGE IN PREDETERMINED PATTERN FOR RESPECTIVE COLORS

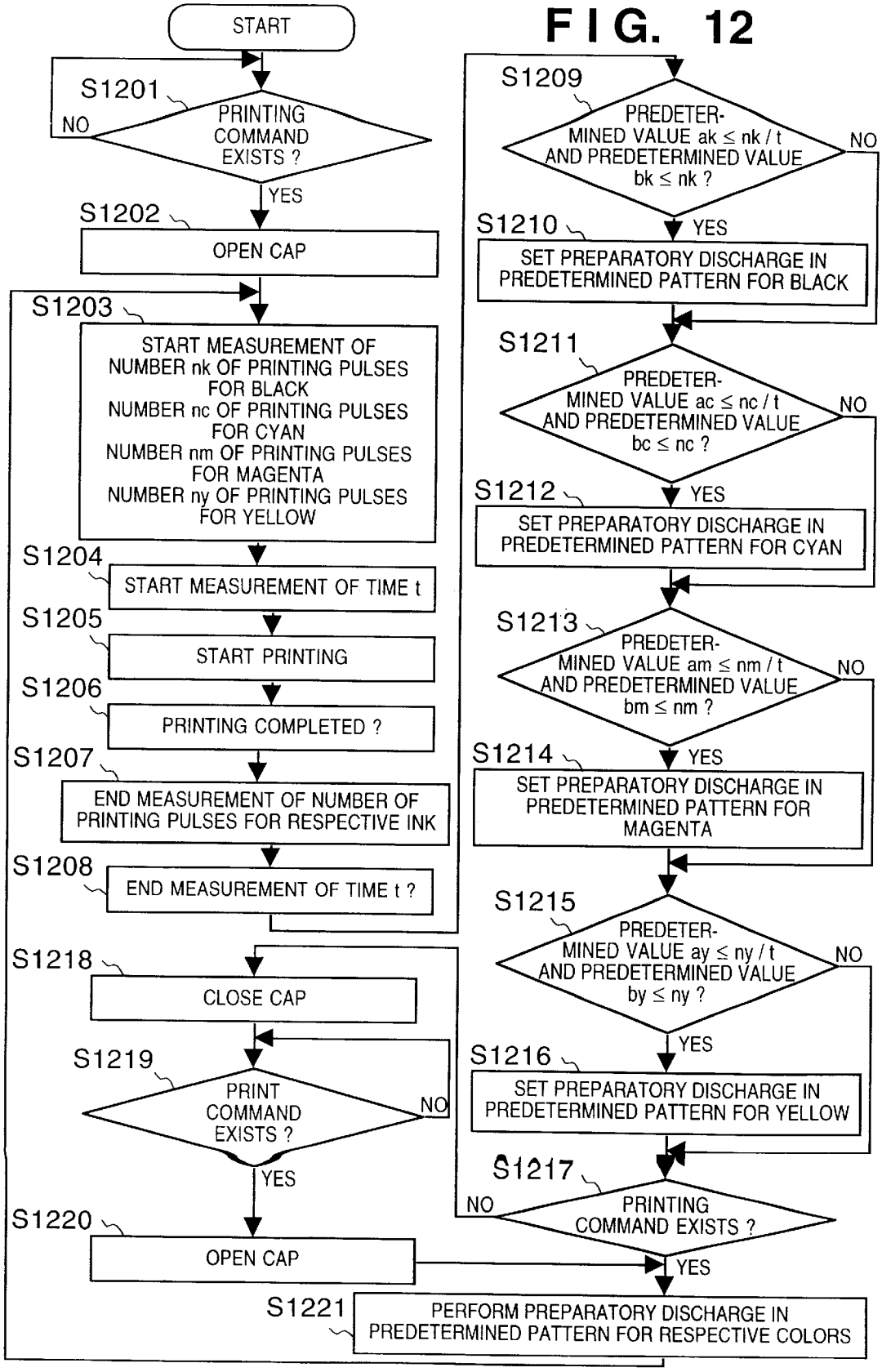
FIG. 12
START
S1201
PRINTING COMMAND EXISTS ?
NO
YES
S1202
OPEN CAP
S1203
START MEASUREMENT OF NUMBER nk OF PRINTING PULSES FOR BLACK
NUMBER nc OF PRINTING PULSES FOR CYAN
NUMBER nm OF PRINTING PULSES FOR MAGENTA
NUMBER ny OF PRINTING PULSES FOR YELLOW
S1204
START MEASUREMENT OF TIME t
S1205
START PRINTING
S1206
PRINTING COMPLETED ?
S1207
END MEASUREMENT OF NUMBER OF PRINTING PULSES FOR RESPECTIVE INK
S1208
END MEASUREMENT OF TIME t ?
S1209
PREDETERMINED VALUE ak ≤ nk / t AND PREDETERMINED VALUE bk ≤ nk ?
NO
YES
S1210
SET PREPARATORY DISCHARGE IN PREDETERMINED PATTERN FOR BLACK
S1211
PREDETERMINED VALUE ac ≤ nc / t AND PREDETERMINED VALUE bc ≤ nc ?
NO
YES
S1212
SET PREPARATORY DISCHARGE IN PREDETERMINED PATTERN FOR CYAN
S1213
PREDETERMINED VALUE am ≤ nm / t AND PREDETERMINED VALUE bm ≤ nm ?
NO
YES
S1214
SET PREPARATORY DISCHARGE IN PREDETERMINED PATTERN FOR MAGENTA
S1215
PREDETERMINED VALUE ay ≤ ny / t AND PREDETERMINED VALUE by ≤ ny ?
NO
YES
S1216
SET PREPARATORY DISCHARGE IN PREDETERMINED PATTERN FOR YELLOW
S1217
PRINTING COMMAND EXISTS ?
NO
YES
S1218
CLOSE CAP
S1219
PRINT COMMAND EXISTS ?
NO
YES
S1220
OPEN CAP
S1221
PERFORM PREPARATORY DISCHARGE IN PREDETERMINED PATTERN FOR RESPECTIVE COLORS

INK-JET PRINTING APPARATUS AND DISCHARGE RECOVERY METHOD THEREFOR

BACKGROUND OF THE INVENTION

The present invention relates to an ink-jet printing apparatus and a discharge recovery method for an ink-jet printhead.

Printing apparatus having functions of a printer, a copier, a facsimile and the like, or printing apparatus used as output devices of integrated electronic device or work station including a computer, a word processor and the like, print an image (including characters and the like) on a print material (print medium) such as print paper and plastic sheet based on image information (including character information and the like).

The printing apparatus classify into ink-jet type printers, wire-dot type printers, thermal printers, laser-beam type printers and the like, in accordance with printing method. Among these printers, the ink-jet type printers (ink-jet printer) perform printing by discharging ink from printing means (printhead) onto a print medium. The printing means can be compact in size. Further, these printers can print a high definition image, at a high speed, on a normal print sheet without any special processing. Further, the printers have many advantages such as a low running cost, non-impact low-noise printing, and easy color image printing using ink of multiple colors. Above all, a line-type printer using a full-multi-type printing means with a number of discharge orifices arrayed in a paper width direction can attain higher printing speed.

Among the ink-jet methods used in the above ink-jet type printers, some methods generate heat in discharging ink droplets. The heat generation includes positive heat generation for ink discharge, i.e., ink discharge by utilizing thermal energy, and heat generation accompanying ink discharge. A typical example of printer according to a method for discharging ink by utilizing thermal energy is an ink-jet printer which causes film boiling in ink by thermal energy generated by electrothermal transducers as discharge energy generators, and discharges ink based on radical formation of bubble by the film boiling. Further, an example of an ink discharge method accompanied with heat generation is a well-known method employing piezoelectric devices as discharge energy generators. In this method, when the piezoelectric device vibrates for ink discharge, it generates heat, although the amount of thermal energy is small.

In these ink-jet printers, if ink discharge is continuously performed in case of printing at a comparatively high printing duty such as printing of a graphic image or image including a solid-print portion, a driving interval to drive the discharge energy generators becomes short. In this case, next ink discharge is performed before excessive heat generated upon ink discharge is sufficiently radiated. As heat is accumulated in ink within ink channels having the discharge energy generators, the temperature of the ink rises. At this time, minute bubbles generated from air dissolved in the ink within the ink channels grow, and further, the bubbles grow by coalescing with each other. The grown bubbles stay in the ink channels to influence ink discharge, further, change discharge directions and discharge amounts. Thus, ink discharge becomes unstable.

Conventionally, to prevent the inconvenience due to the above-described residual bubbles, the residual bubbles have been removed from the ink channels by forcibly sucking ink within the ink channels via discharge orifices by using a predetermined suction mechanism or by applying pressure to the ink channels by using a predetermined pressurization mechanism. However, as the amount of ink discharged by the suction-or pressurization operation is comparatively large, the amount of ink unnecessarily consumed for such purpose other than printing is large. As a result, the running cost of the printer increases. Further, to perform suction or pressurization, a comparatively large number of operations including movement of a printhead to a capping position, capping, suction and pressurization are required. If the processing is performed during printing, the printing speed becomes lower in the entire printer. To address these problems, a technique to perform discharge recovery by discharging the above-described bubbles by continuously performing ink discharge plural times from the ink channels, except a bubble-discharge target channel but including at least its adjacent ink channels (Japanese Patent Laid-Open No. 4-219253) is disclosed.

However, to output an image with inconspicuous jaggies in black characters and the like or to output a color image as a more pictorial high-quality image, if the print pixel density is raised by changing the conventional 40 pl to 60 pl discharge amount to that of smaller droplets, the following problem occur.

First, materials dissolved in ink is precipitated by heat accompanying ink discharge, and the precipitate accumulated around the discharge orifices, the discharge energy generators or within the ink channels also influences ink discharge. For example, if polyurethane sponge is used in an ink tank, polyol, yielded by hydrolytic degradation by heat at a polyurethane sponge manufacturing process, exists as dissolved material in the ink. The polyol dissolved in the ink is precipitated by heat accompanying ink discharge. In the conventional discharge amount, the amount of discharged ink is overwhelmingly larger than the amount of precipitate, therefore the precipitate does not influence ink discharge. However, in the discharge amount of smaller droplets, the precipitate greatly disturbs the precision of ink application position.

Secondly, the influence of the above-described residual bubbles on ink discharge changes in accordance with a printing history of past printing about the number of printing pulses, the printing time, the printing area and the like, and the time elapsed from the completion of printing. If discharge recovery operation is performed regardless of history of past printing and time elapsed from the completion of printing as in the case of the conventional art, the discharge recovery cannot be sufficiently performed, or the amount of unnecessarily consumed ink increases. Also, the influence of the above-described precipitate on ink discharge greatly differs in accordance with history of past printing and time elapsed from the completion of printing.

Further, the amount of precipitate differs in. accordance with ink type, and the influence of the precipitate on ink discharge differs in accordance with the amount of precipitate.

SUMMARY OF THE INVENTION

The present invention has been made to solve the above-described problems, and has its object to provide an ink-jet printing apparatus and a discharge recovery method for an ink-jet printhead which prevent reduction of printing speed and increase in ink consumption amount by unnecessary discharge recovery processing, and which maintain excellent image quality.

According to the present invention, the foregoing object is attained by providing an ink-jet printing apparatus having a printhead with a plurality of discharge orifices, including heat sources, for discharging ink droplets, comprising: detection means for detecting a driving state of the printhead per unit period; determination means for determining whether or not the driving state detected by the detection means has become a predetermined state; control means for performing discharge recovery processing on the printhead if it is determined by the determination means that the printhead has entered the predetermined state.

Further, according to the present invention, the foregoing object is attained by providing a discharge recovery method for an ink-jet printing apparatus, having a plurality of discharge orifices including discharge energy generators corresponding to the discharge orifices, for performing printing by discharging different types of ink from a plurality of printheads onto a print medium, wherein if the conditions of the history of past printing meet predetermined conditions, preparatory discharge is performed in a predetermined pattern, for discharge recovery.

Preferably, the conditions of the printing history of past printing, the predetermined conditions and the preparatory discharge in the predetermined pattern, differ by each ink type.

Preferably, the conditions of the printing history of past printing include the number (n) of printing pulses and the printing time (t) in the past printing; and the predetermined conditions include a predetermined value (a)≦{the number (n) of printing pulses/printing time (t)}. More preferably, the predetermined conditions include the predetermined value (a)≦{the number (n) of printing pulses/printing time (t)} and a predetermined number (b)≦the number (n) of printing pulses.

Preferably, the predetermined conditions include the number (n) of printing pulse and the printing time (t) in the past printing means the number of scan movements of the printhead, or the number (n) of printing pulses and the printing time (t) in printing for a predetermined number of pages.

Further, the preparatory discharge in the predetermined pattern may be performed if the predetermined conditions are satisfied while the printing time (t) or the number (n) of printing pulses in the past printing has a fixed value.

Further, the conditions of the printing history in past printing may include the number (n) of printing pulses and the print area (w) in the past printing. The predetermined conditions include a predetermined value (d)≦{the number (n) of printing pulses/print area (w)}, or preferably, the predetermined value (d)≦{the number (n) of printing pulses/print area (w)} and a predetermined value (e)≦the number (n) of printing pulses.

Preferably, the preparatory discharge in the predetermined pattern is dividing the array of plurality of discharge orifices (L) into s (s is a divisor of L) groups, and among discharge orifices having numbers obtained by (s×x−y) (x is an integer from 1 to L/s), continuously driving discharge energy generators, from an orifice with a number obtained when y=0 holds to an s-1 th orifice, plural times alternately, and not driving the orifices for a predetermined period of time, at fixed intervals, thus performing discharging from all the discharge orifices.

Preferably, the discharge recovery may be made by performing the preparatory discharge in the predetermined pattern which differs in accordance with the time elapsed from detection of fulfillment of the conditions. More preferably, by performing the preparatory discharge in the predetermined pattern where the number of driving pulses increases as the elapsed time increases.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 8 is a flowchart showing discharge recovery processing according to the first embodiment;

FIG. 12 is a flowchart showing the discharge recovery proessing according to a second embodiment of the present invention;

DETAILED DESCRIPTION OF THE PREFERRED EMBODIMENTS

Preferred embodiments of the present invention will now be described in detail in accordance with the accompanying drawings.

First, the principal constituent elements of an ink-jet printing apparatus which preferably embodying the present invention will be described with reference to the drawings.

<Printing Apparatus >

Figure 1:
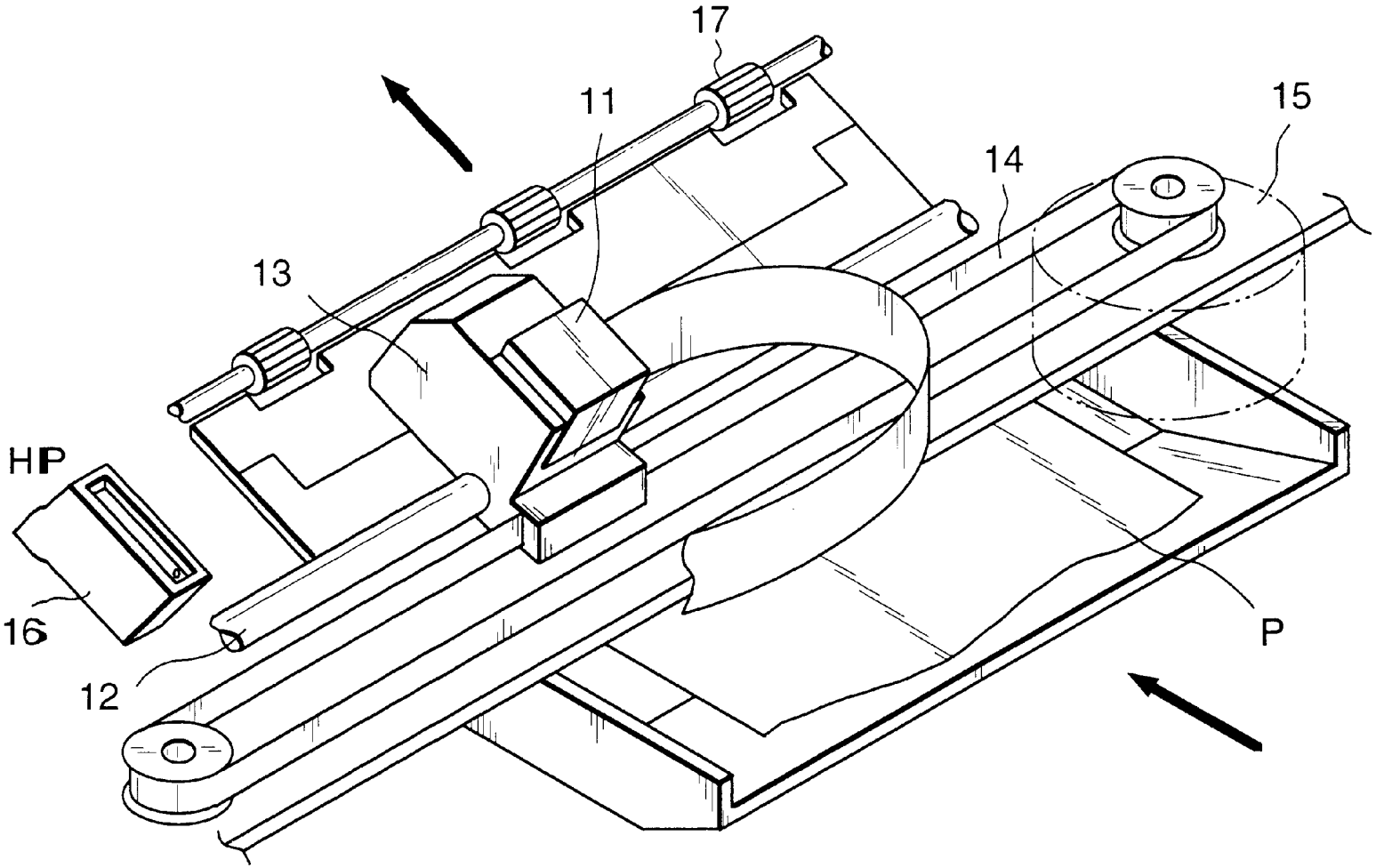
FIG. 1 is a perspective view showing the principal constituent element of an ink-jet printing apparatus.

FIG. 1 is a perspective view showing principle constituent elements of an ink-jet printing apparatus of the present invention.

An ink-jet head unit 11 having an array of discharge orifices to discharge ink is mounted on a carriage 13. A print medium P comprising print paper, a plastic sheet or the like is held by discharge rollers 17 via conveyance rollers (not shown), and sent in an arrow direction in accordance with driving by a conveyance motor (not shown). The carriage 13 is guided by a guide shaft 12 and an encoder (not shown). The carriage 13 performs a reciprocating motion (scanning motion) along the guide shaft 12, driven by a carriage motor 15 via a driving belt 14. In the ink-jet head unit (details will be described later with reference to FIGS. 2, 3, or 4 and 5), heat generators (electrothermal energy transducers) for generating ink-discharge thermal energy are provided inside the ink discharge orifices (liquid channels) of respective printheads. Image formation is made by driving the above-described heat generators based on a print signal at reading timing of the encoder (not shown) and discharging ink droplets onto the print medium P.

A recovery unit having a cap 16 is provided in a home position (HP) of the carriage out of a printing area. When printing is not performed, the carriage 13 is moved to the home position (HP), and a surface of the ink-jet head unit where the ink discharge orifices are formed is sealed by the cap 16, to prevent the discharge orifices from clogging with attached ink due to evaporation of ink solvent or attached particles such as dust and paper particles.

Further, as the capping function of the cap 16 prevents discharge failure or clogging at an ink discharge orifice with a low frequency of use, due to increase in ink viscosity, setting of ink and the like, the cap 16 is utilized in a preparatory discharge mode to discharge ink toward the cap 16 away from the ink discharge orifices, and utilized in discharge recovery on an ink discharge orifice which caused discharge failure, by operating a pump (not shown) while putting the cap on the orifice, and sucking ink from the ink discharge orifice. Further, by providing a blade in a position adjacent to the cap, cleaning (wiping) can be performed on the surface of the ink-jet head unit having the ink discharge orifices.

<Printhead>

Figure 2:
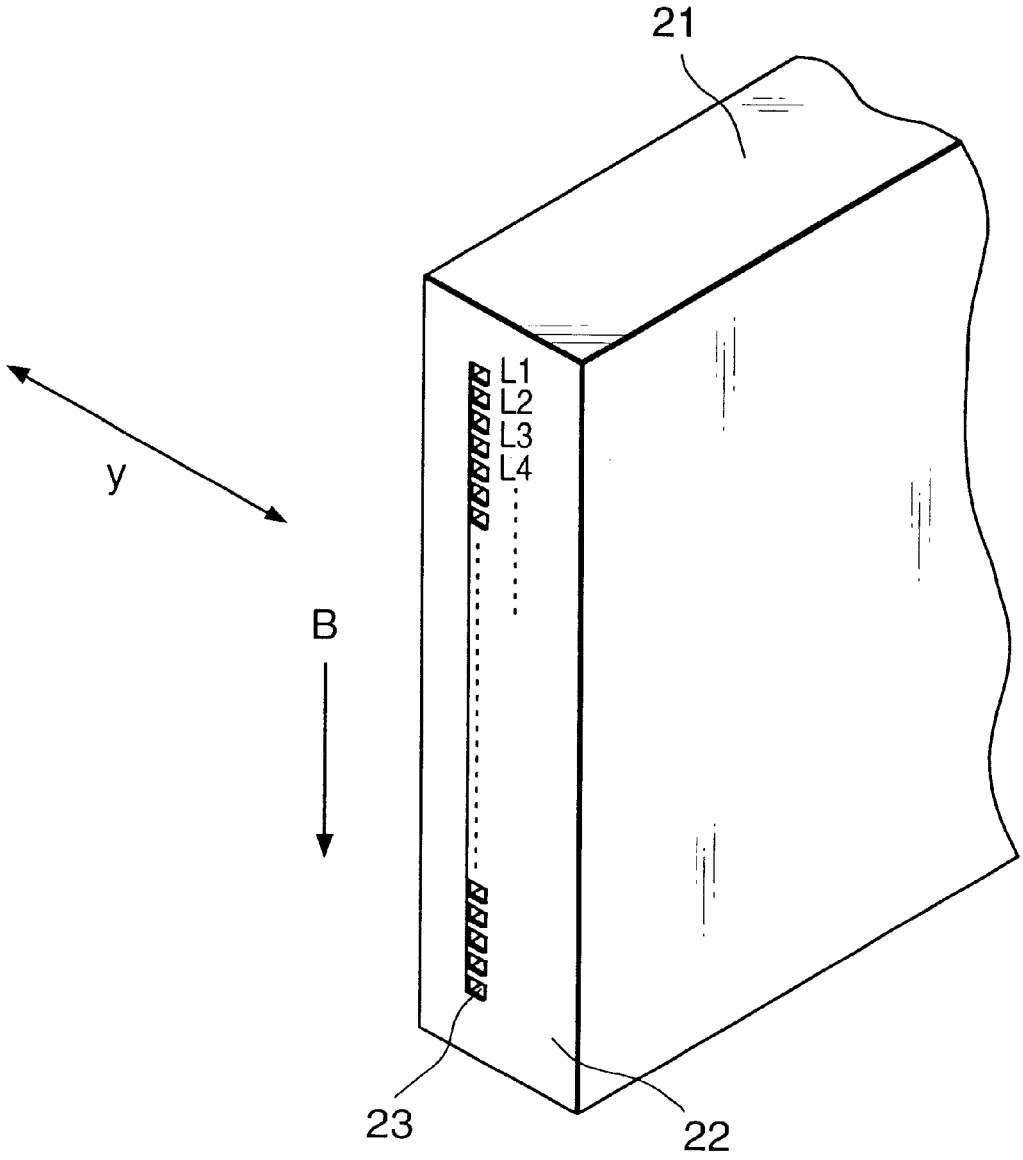
FIG. 2 is a partial perspective view showing a printhead with an array of discharge orifices.
Figure 3:
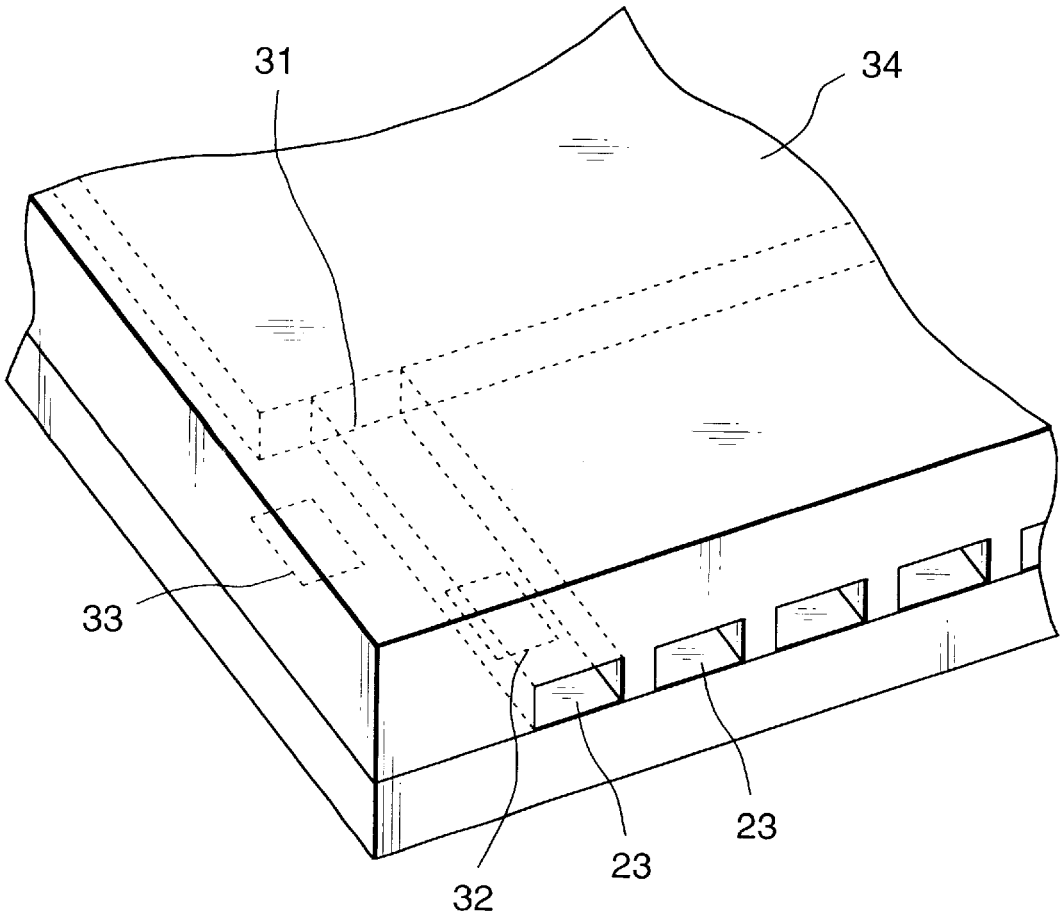
FIG. 3 is a partial perspective view showing the structure of an ink discharge portion of the printhead with the array of discharge orifices.

FIG. 2 is a partial perspective view of the array of the ink discharge orifices of the printhead as ink discharge means, viewed from the side of the print medium. FIG. 3 is an enlarged partial perspective view of the structure of the ink discharge orifices of the printhead in FIG. 2. The printhead has a discharge orifice surface 22 having a plurality of discharge orifices 23. Discharge energy generators 32 to generate energy (thermal energy) necessary for ink discharge are provided in liquid channels 31 communicating with the discharge orifices 23. An arrow y indicates a scanning direction of the carriage 13. In FIG. 3, numeral 33 denotes a sensor for detecting the temperature of the printhead. In the present embodiment, a diode sensor 33 is provided on both ends of the array of the discharge orifices. Note that the temperature detection means is not limited to this sensor, but other sensors such as a thermister may be employed. Further, the temperature of the printhead may be calculated from a print dot duty. Numeral 34 denotes a common liquid chamber. The discharge orifices of the printhead are numbered L1, L2, L3, L3, L4, . . . , along an arrow B direction in FIG. 2.

Figure 4:
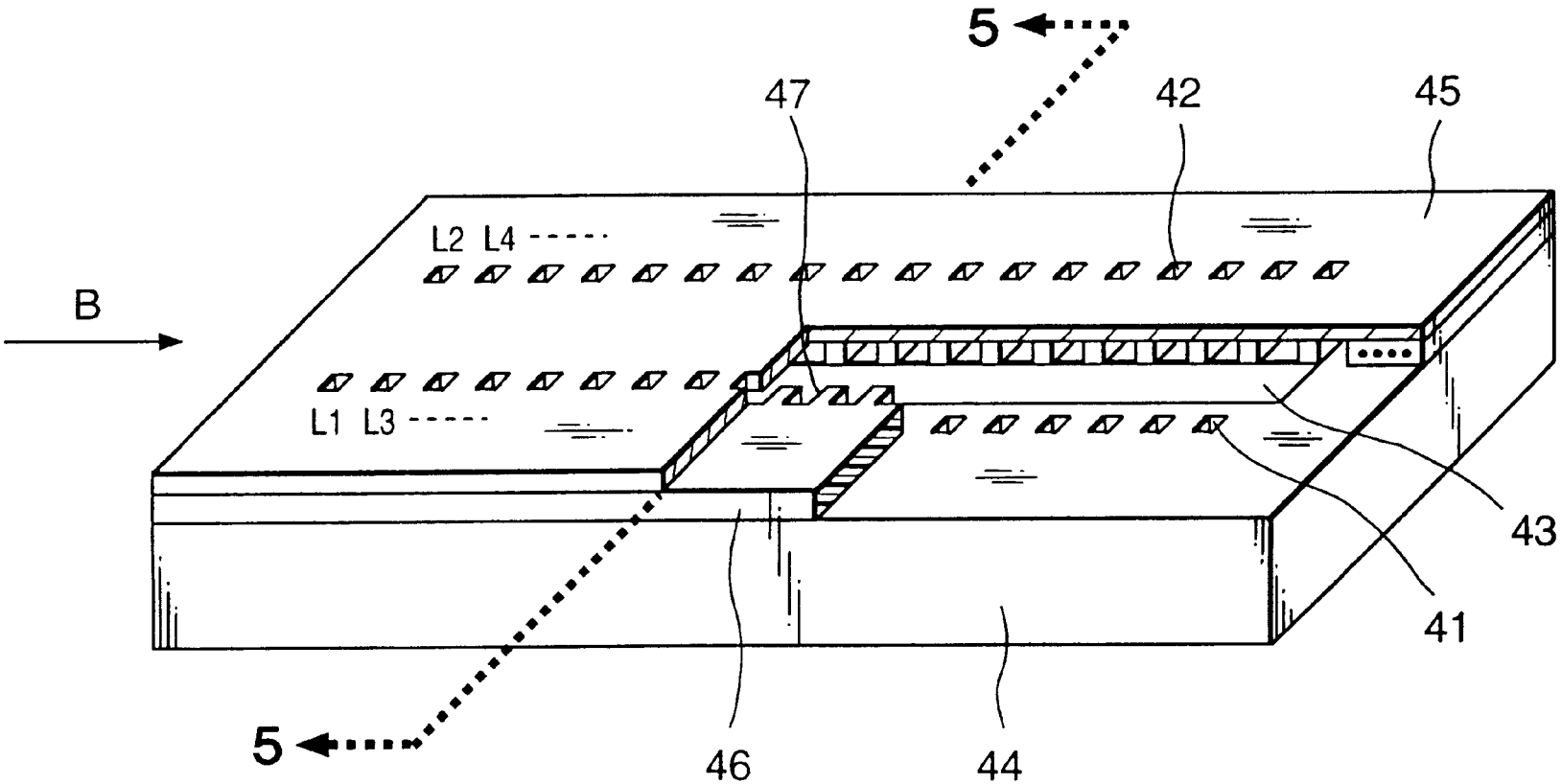
FIG. 4 is a perspective view showing a printhead with two rows of staggered discharge orifices.
Figure 5:
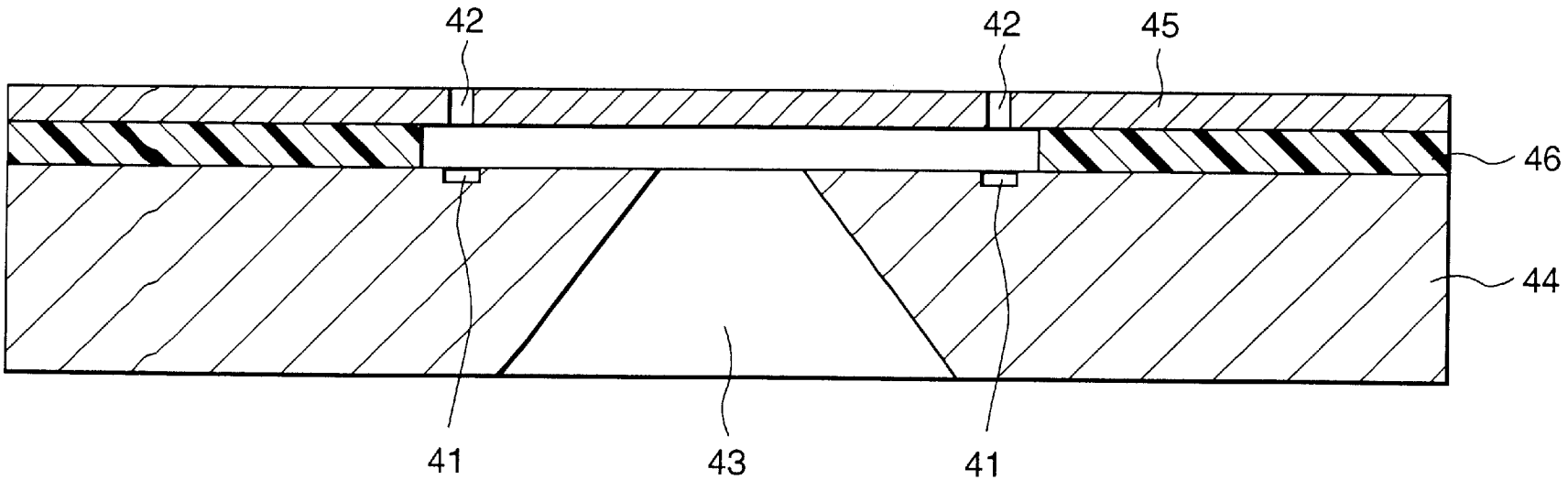
FIG. 5 is a cross sectional view of the printhead with the two rows of staggered discharge orifices in FIG. 4, cut along a line A—A'.

FIG. 4 is a perspective view showing the schematic structure of a printhead with two rows of staggered discharge orifices (numeral 42 denotes a discharge orifice). FIG. 5 is a cross sectional view of the printhead with the two rows of staggered discharge orifices in FIG. 4, cut along a line A—A'. A substrate 44 comprising glass, ceramic, plastic or metal and the like, is employed. There is no limitation on the material of the substrate 44 as long as the substrate functions as a part of liquid chamber constituent member and functions as a member supporting a material layer forming the liquid channel portion and discharge orifices 42. The substrate 44 has ink supply orifice 43 comprising a groove type through hole to supply ink. On the substrate 44, two rows of staggered discharge energy generators 41 are provided on both sides of the ink supply orifice 43 in its lengthwise direction. A coated resin layer 46 having liquid channel walls 47 forming the liquid channel portion is provided on the substrate 44, and a discharge orifice plate 45 having the discharge orifices 42 corresponding to the respective discharge energy generators 41 is provided on the coated resin layer 46. The discharge orifices of the printhead are numbered L1, L2, L3, L4, . . . along the arrow B direction in FIG. 4.

<Control Construction>

Figure 6:
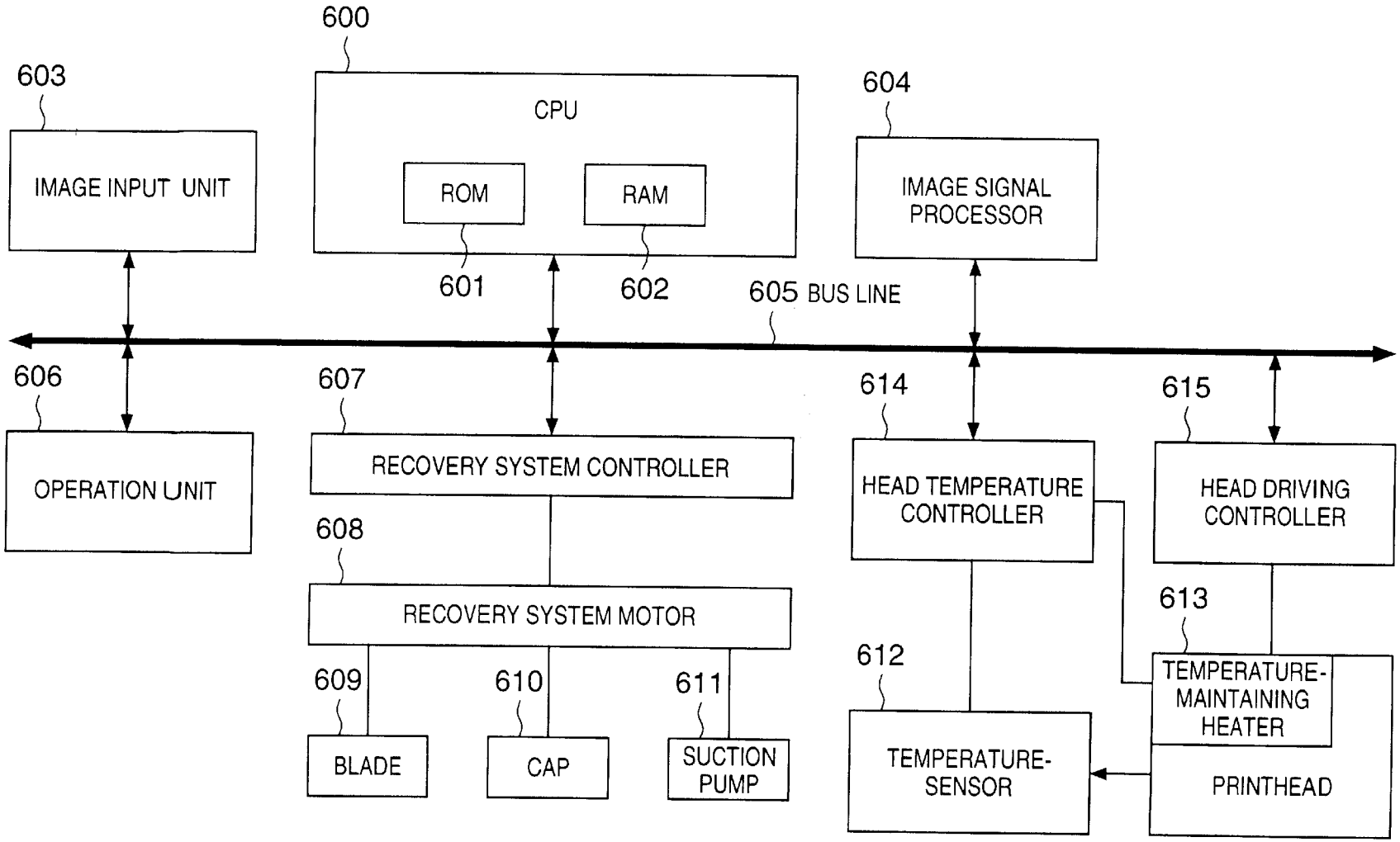
FIG. 6 is a block diagram showing the construction of a printing according to a first embodiment of the present invention.

FIG. 6 is a block diagram showing the control construction of the ink-jet printing apparatus. In FIG. 6, the construction divides into software processing means such as an image input unit 603, an image signal processor 604 corresponding to the image input unit 603, and a central processing unit (CPU) 600, which respectively access a main bus line 605, and hardware processing means such as an operation unit 606, a recovery system controller 607, a head temperature controller 614 and a head driving controller 615. Note that the image input unit 603 may be an image scanner if the printing part of the present embodiment is applied to a copier, or may be an interface if the printing part of the present embodiment is applied to a single printing apparatus connected to a host computer.

The CPU 600 generally has a read only memory (ROM) 601 and a random access memory (RAM) 602. The CPU 600 drives a printhead 613 while providing the printhead with appropriate printing conditions based on input information, to perform printing. The ROM 601 contains a program to perform a head recovery operation as well as a program to perform a normal printing operation. The head recovery program provides recovery conditions such as preparatory discharge conditions to the recovery system controller 607, the printhead, a temperature-maintaining heater and the like, in accordance with necessity. A recovery system motor 608 drives a cleaning blade 609, a cap 610 and a suction pump 611 opposite to and away from the printhead 613.

The CPU 600 generally has a read only memory (ROM) 601 and a random access memory (RAM) 602. The CPU 600 drives a printhead 613 while providing the printhead with appropriate printing conditions based on input information, to perform printing. The ROM 601 contains a program to perform a head recovery operation as well as a program to perform a normal printing operation. The head recovery program provides recovery conditions such as preparatory discharge conditions to the recovery system controller 607, the printhead, a temperature-maintaining heater and the like, in accordance with necessity. A recovery system motor 608 drives the printhead 613 and a cleaning blade 609, a cap 610 and a suction pump 611 opposite to and away from the printhead 613.

The head driving controller 615 executes driving on the conditions for driving the ink discharge electrothermal transducers of the printhead 613. Generally, the head driving controller 615 causes the printhead 613 to perform preparatory discharge and printing ink discharge.

On the other hand, in the printhead 613, the temperature-maintaining heater is provided on the substrate having the ink-discharge electrothermal transducers, to control the ink temperature within the printhead to a desired temperature by heating. Further, a temperature sensor 612 is the above-described diode sensor 33. Practically, the ink temperature within the printhead may be indirectly measured, accordingly, the sensor 612 may be provided, not on the substrate, but outside the printhead. The sensor 612 may be provided on the periphery of the printhead.

Next, the characteristic features of the embodiments in the above construction will be described below.

First Embodiment

In a first embodiment of the present invention, the printing apparatus has four printheads respectively having an array of ink discharge orifices as shown in FIG. 2, for discharging black ink, cyan ink, magenta ink, and yellow ink, respectively. The printheads used in discharge recovery processing according to the first embodiment respectively have 256 discharge orifices (the number L of discharge orifices=256), arranged at 1/600 inch intervals, i.e., having 600 dpi printing pixel density (resolution).

Figure 7:
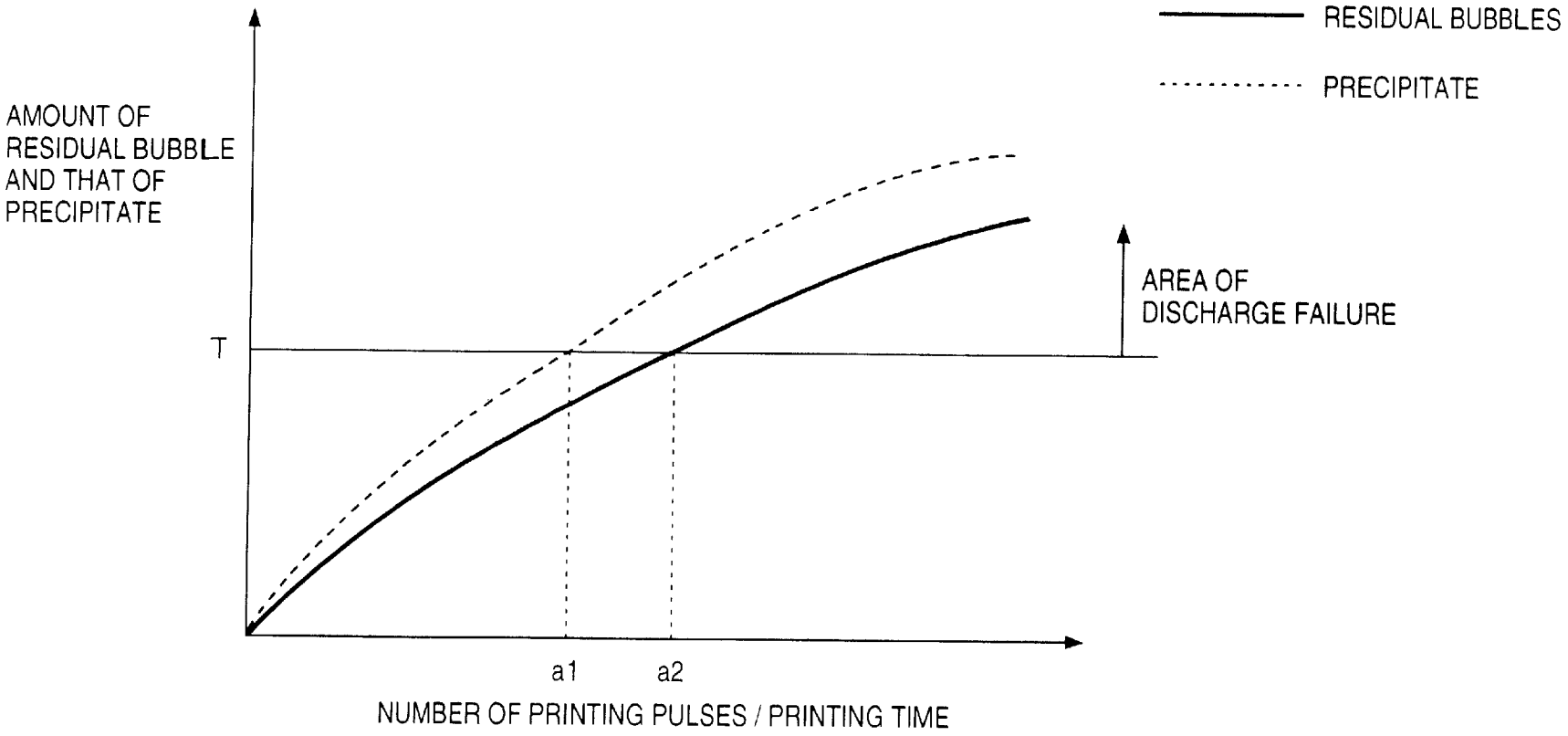
FIG. 7 is a graph explaining the relation between the amount of residual bubbles and that of a precipitate in black ink, and {the number of printing pulses/printing time}.

FIG. 7 is a graph showing the result of study of the relation between the number of printing pulses per unit period, obtained by dividing the number of printing pulses to all the 256 discharge orifices by printing time, and the amount of residual bubbles and precipitate in black ink caused by printing. As shown in FIG. 7, as the number of printing pulses per unit period increases, the amount of residual bubbles and precipitate increase. It has been found that if the number of printing pulses/printing time is "a1" and "a2", the amount of precipitate and that of residual bubbles are "T", when discharge failure occurs (hereinafter, the values "a1" and "a2" will be referred to as "critical values" to insure printing quality). The other colors show similar tendencies. In comparison among the colors, the values "a1" and "a2" both increase in accordance with ink characteristics in descending order, yellow, magenta, cyan and black. Further, it has been found that in each of the other color ink, the result of study of the relation between the number of printing pulses per unit period, obtained by dividing the number of printing pulses to all the 256 discharge orifices by printing time, and the amount of residual bubbles and that of a precipitate, shows a similar tendency to that shown in FIG. 7.

FIG. 8 is a flowchart showing the discharge recovery processing according to the first embodiment. Hereinbelow, the operation of the discharge recovery processing will be described.

First, in determination of existence/absence of printing command (step S801), if no printing command exists, a printing command is waited.

If the printing command exists, the cap is opened (step S802), and measurement of the total numbers of printing pulses, as variables nk for black, nc for cyan, nm for magenta and ny for yellow, from the respective 256 discharge orifices of the respective printheads, is started (step S803). At the same time, measurement of printing time t is started (step S804) and printing is started (step S805). When it is determined that the printing has been completed (step S806), the measurement of the total numbers of printing pulses, nk, nc, nm and ny is terminated (step S807) and the measurement of the printing time t is terminated (step S808).

Next, it is determined whether or not the number of printing pulses for black per 1 second as printing time, nk/t, is equal to or greater than a predetermined value ak (ak=150000) which is somewhat less than the critical value al for black ink in FIG. 7 (step S809). Note that the predetermined value ak (and ac, am and ay to be described below) is less than the critical value al to make allowance to insure printing quality. If ak≦nk/t holds, preparatory discharge in a predetermined pattern for black is set (step S810).

Similarly, it is determined whether or not the number of printing pulses for cyan per 1 second, nc/t is equal to or greater than the predetermined value ac which is less than the predetermined value ak for black (ac=100000) (step S811). If ac≦nc/t holds, preparatory discharge in a predetermined pattern for cyan is set (step S812). Similarly, it is determined whether or not the number of printing pulses for magenta per 1 second, nm/t is equal to or greater than the predetermined value am which is less than the predetermined value ac for cyan (am=90000) (step S813). If am≦nm/t holds, preparatory discharge in a predetermined pattern for cyan is set (step S814). Similarly, it is determined whether or not the number of printing pulses for yellow per 1 second, ny/t is equal to or greater than the predetermined value ay which is less than the predetermined value am for magenta (ay=80000) (step S815). If ay≦ny/t holds, preparatory discharge in a predetermined pattern for yellow is set (step S816).

Thereafter, existence/absence of printing command is determined (step S817). If a printing command exists, preparatory discharge in the predetermined pattern is performed for the respective colors (step S821). If no printing command exists, the cap is closed (step S818), and existence/absence of printing command is determined. If no printing command exists, a printing command is waited. If a printing command exists, the cap is opened (step S820), and preparatory discharge in the predetermined pattern is performed for the respective colors (step S821). Then, at steps S803 and S804, the measurement of the total numbers of printing pulses, nk, nc, nm and ny, and the measurement of the printing time t are started again.

Note that in the above description, the determination of existence/absence of printing command may be made by determining whether or not image data to be print-outputted exists in the RAM. Further, if the present embodiment is applied to a copier, the determination of existence/absence of printing command may be replaced with determination of existence/absence of copying instruction.

Further, in use of printing mechanism to scan a carriage, the determination of the completion of printing at step S806 may be made upon each scanning or may be made for one page. Further, the determination of the completion of printing may be made based on whether or not a predetermined number of scanning operations have been performed, or may be made based on whether or not a predetermined number of pages have been printed. In any case, if the present embodiment is applied to a printer connected to a host computer, the host computer may transfer print data for, e.g., several tens of pages, as one job. In this case, it is better not to terminate the processing at step S806 upon the completion of one job. That is, the determination of the completion of printing is made at intervals independent of the amount of job.

Next, an example of processing for executing the preparatory discharge in the predetermined pattern (S821) in FIG. 8 will be described with reference to a flowchart of FIG. 9.

The array of 256 discharge orifices is divided into s (s=2) groups, and discharge orifices having numbers obtained by (s×x−y)=(2×x−y) (x is an integer up to 128 obtained by dividing the number of discharge orifices 256 by s=2), (y=0), i.e., even-numbered discharge orifices (L2, L4, L6, L8, . . . ) are continuously driven K1 times at a driving frequency 10 KHz (step S901). Then, y=s−1=1, i.e., odd-numbered discharge orifices (L1, L3, L5, L7, . . . ) are continuously driven K2 times at the driving frequency 10 KHz (step S902). These operations are repeated K3 times. The values of the K1 and K2 are 128 for the four colors, and the value of the K3 is 24. Further, the values from K1 to K3 may be changed in accordance with the ink characteristics, the shape of ink discharge orifices and the type of discharge energy generators.

As described above, to obtain the amount of residual bubbles and that of a precipitate, the number of printing pulses and the printing time from the start to end of printing are measured for the respective ink types, and the number of printing pulses/printing time is obtained. Thus, preparatory discharge in a predetermined pattern to effectively discharge the residual bubbles and precipitate is performed for each ink type, only when the obtained printing pulses/printing time is equal to or greater than a predetermined value to cause discharge failure. This attains excellent image printing without unnecessary increase in ink consumption and without reduction of the printing speed.

In the present embodiment, the amount of residual bubbles and that of precipitate are obtained by measuring the number of printing pulses in a predetermined unit and the printing time from the start to the end of printing and obtaining the number of printing pulses/printing time. However, the amount of residual bubbles and that of precipitate may be obtained by measuring the number (n) of printing pulses from the start to the end of printing and a printing area (w) and obtaining the number (n) of printing pulses/printing area (w). In this case, only if a predetermined value to cause discharge failure (d)≦the number (n) of printing pulses/printing area (w) holds, preparatory discharge in a predetermined pattern is performed to effectively discharge the residual bubbles and the precipitate.

Further, in the present embodiment, the number of printing pulses per unit period is obtained from the number of printing pulses and the printing time from the opening of the cap upon reception of printing-command to the close of the cap. However, the number of printing pulses per unit period i.e., {the number of printing pulses/printing time} may be obtained each time a predetermined period of printing time has elapsed or the number of printing pulses has reached a predetermined value. In this case, regarding each color, if the obtained value is greater than the predetermined value of the color, preparatory discharge in an optimum pattern may be performed for the color. The predetermined value may preferably be determined in accordance with the conditions of the ink characteristic, the shape of ink discharge orifices and the type of discharge energy generators.

Further, in the present embodiment, as the preparatory discharge in the predetermined pattern is continuously performed a plural number of times alternately from odd-numbered discharge orifices and even-numbered discharge orifices. However, to more effectively discharge residual bubbles and a precipitate, the preparatory discharge may be performed in accordance with a flowchart of FIG. 10 to perform preparatory discharge in another predetermined pattern. In this flowchart, a predetermined period of time not to perform discharge (K4=256) is provided at step S1003. The preparatory discharge is not limited to discharge alternately from the even-numbered discharge orifices and odd-numbered discharge orifices. Any other pattern may be used as long as it performs discharge from all the discharge orifices by using a plurality of combinations of discharge orifice numbers. Note that the head driving frequency in preparatory discharge is lower than that in normal printing so as to enhance the effect of preparatory discharge. That is, the interval between head driving operations in preparatory discharge is longer than that in normal printing. Further, in the present embodiment, a printhead having an array of discharge orifices as shown in FIGS. 2 and 3 is used, however, similar advantages can be obtained by using a printhead having two rows of staggered discharge orifices as shown in FIGS. 4 and 5.

Second Embodiment

The printhead used in the discharge recovery processing according to a second embodiment has 256 discharge orifices (the number L of discharge orifices=256), arranged at 1/600 inch intervals, i.e., having 600 dpi printing pixel density (resolution), as that used in the first embodiment. Further, the printing apparatus according to the second embodiment has four printheads for discharging black ink, cyan ink, magenta ink and yellow ink, respectively.

Figure 11:
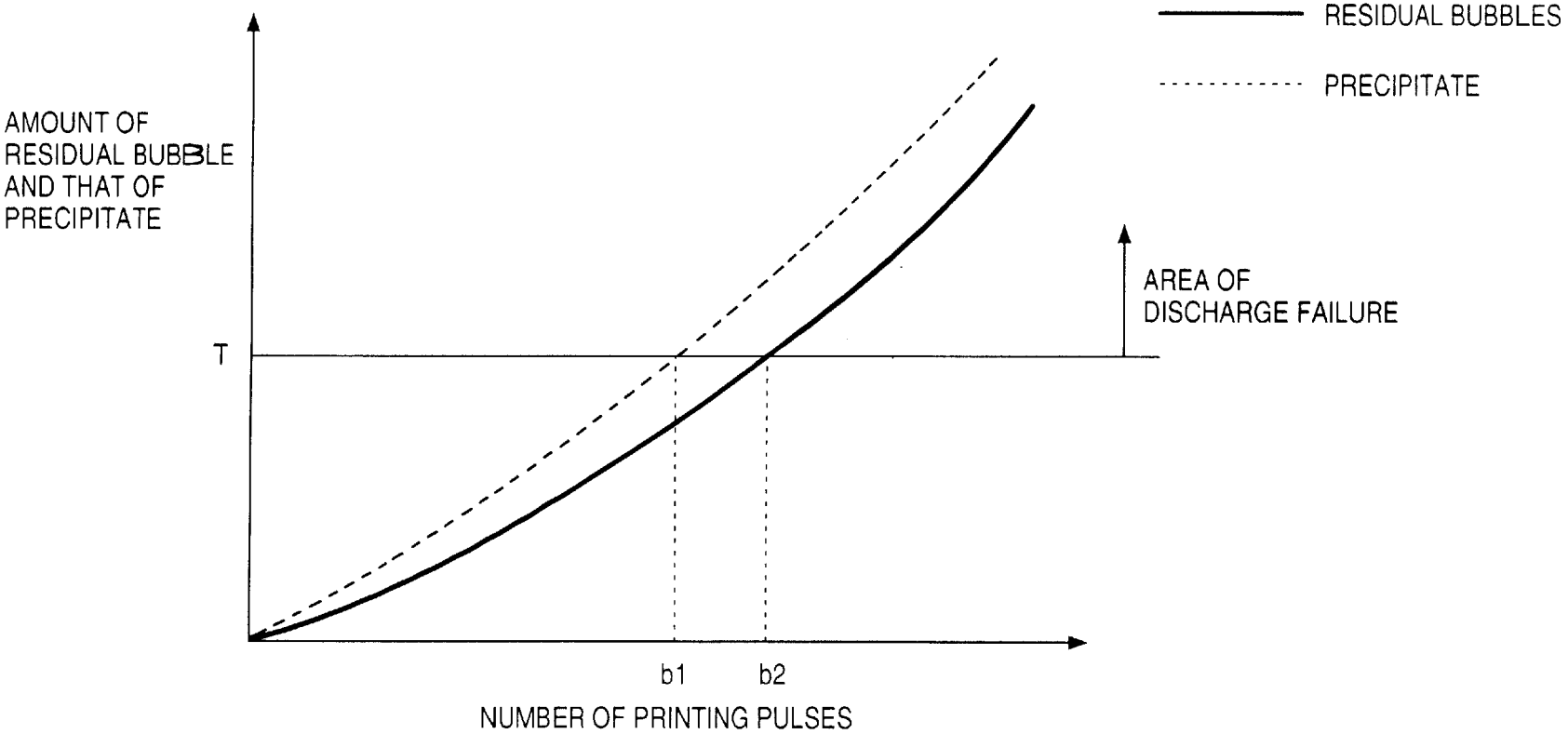
FIG. 11 is a graph explaining the relation between the amount of residual bubbles and that of the precipitate in the black ink, and the number of printing pulses.

FIG. 11 is a graph showing the result of study of the relation between the number of printing pulses, and the amount of residual bubbles and that of the precipitate when {the number of printing pulses/printing time} to cause discharge failure becomes the critical value "a1" in the black ink in FIG. 7. That is, as the number of printing pulses per unit period increases, the amount of residual bubbles and that of the precipitate increase. It has been found that if the number of printing pulses/printing time is "b1" and "b2", the amount of precipitate and that of residual bubbles are "T", when discharge failure occurs. The other colors show similar tendencies. In comparison among the colors, the values "b1" and "b2" both increase in accordance with ink characteristics in descending order, yellow, magenta, cyan and black.

FIG. 12 is a flowchart showing an example of the discharge recovery processing according to the second embodiment.

First, in the determination of existence/absence of printing command (step S1201), if no printing command exists, it is waited. If a printing command exists, the cap is opened (step S1202). The measurement of the total numbers of printing pulses for ink discharge from the 256 discharge orifices of the respective printheads, nk for black, nc for cyan, nm for magenta and ny for yellow, is started (step S1203). At the same time, the measurement of the printing time t is started (step S1204) and printing is started (step S1205).

If it is determined that the printing has been completed (step S1206), the measurement of the total numbers of pulses for respective ink colors, nk, nc, nm and ny is terminated (step S1207) and the measurement of the printing time t is terminated (step S1208).

Then, it is detrained whether or not the number of printing pulses for black per 1 second as printing time, nk/t is equal to or greater than the predetermined value ak (ak=150000) which is less than the critical value al in FIG. 7 and whether or not the number nk of printing pulses for black is equal to or greater than a predetermined value bk (bk=30000000) which is less than the value b1 in FIG. 11 (step S1209). If ak≦nk/t and bk≦nk hold, preparatory discharge is in a predetermined pattern for black is set (step S1210).

Similarly, it is determined whether or not the number of printing pulses for cyan per 1 second, nc/t is equal to or greater than the predetermined value ac (ac=100000) which is less than the predetermined value ak for black and whether or not the number nc of printing pulses for cyan (less than nk) is equal to or greater than a predetermined value bc (bc=24000000) (step S1211). If ac≦nc/t and bc≦nc hold, preparatory discharge is in a predetermined pattern for cyan is set (step S1212). Similarly, it is determined whether or not the number of printing pulses for magenta per 1 second, nm/t is equal to or greater than the predetermined value am (am=90000) which is less than the predetermined value ac for cyan and whether or not the number nm of printing pulses for magenta (less than nc) is equal to or greater than a predetermined value bm (bm=22000000) (step S1213). If am≦nm/t and bm≦nm hold, preparatory discharge in a predetermined pattern for magenta is set (step S1214). Similarly, it is determined whether or not the number of printing pulses for yellow per 1 second, ny/t is equal to or greater than the predetermined value ay (ay=80000) which is less than the predetermined value am for magenta and whether or not the number ny of printing pulses for yellow (less than nm) is equal to or greater than a predetermined value by (by=20000000) (step S1215). If ay≦ny/t and by≦ny hold, preparatory discharge in a predetermined pattern for yellow is set (step S1217).

Figure 13:
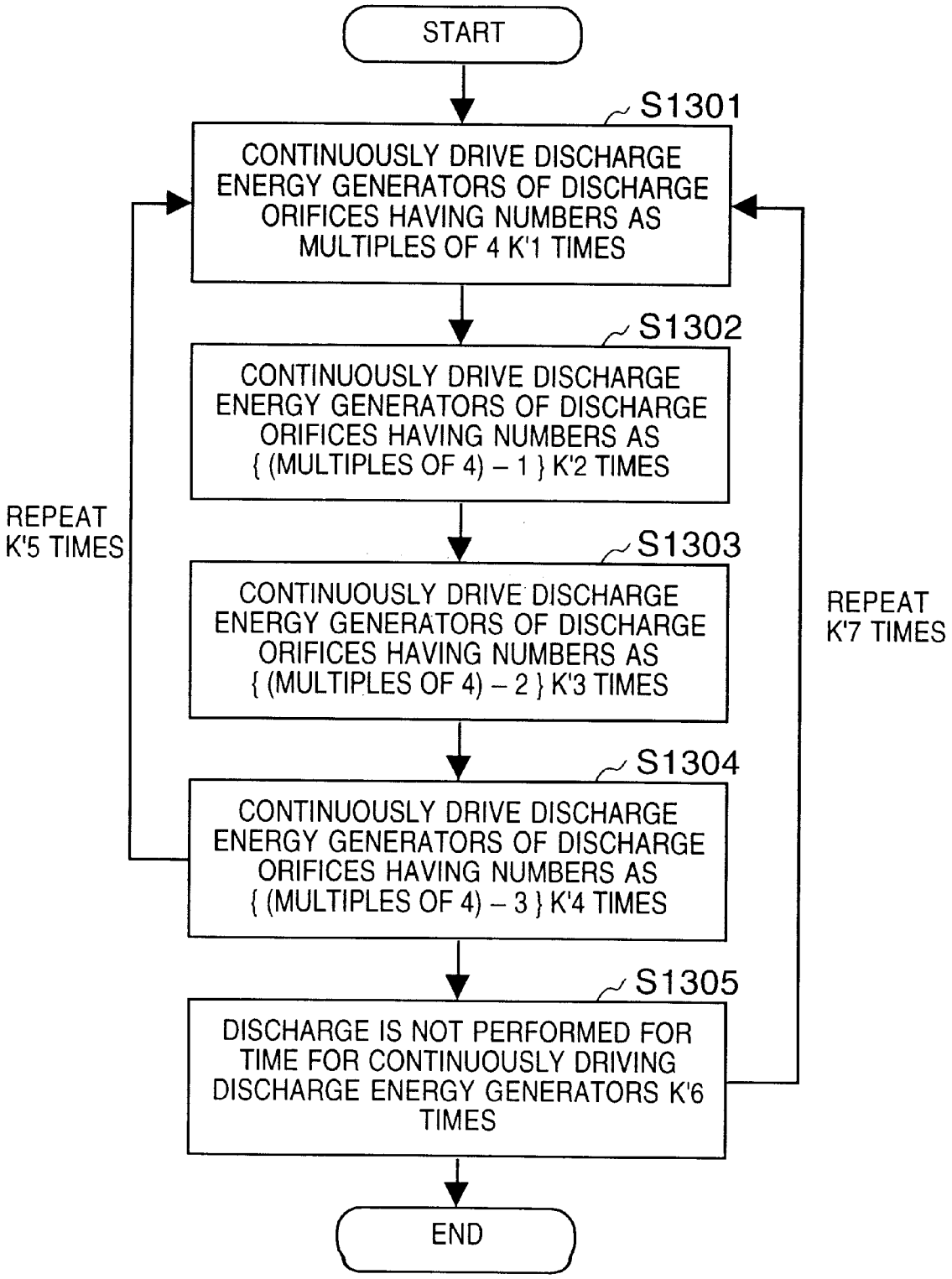
FIG. 13 is a flowchart for execution of preparatory discharge in a predetermined pattern according to the second embodiment.

If a printing command exists, preparatory discharge in the predetermined pattern is performed for the respective colors (step S1221). If no printing command exists, the cap is closed (step S1218), and determination on existence/absence of printing command is performed (step S1219). If no printing command exists, it is waited, while if a printing command exists, the cap is opened (step S1220), and the preparatory discharge in the predetermined pattern is performed for the respective colors (step S1221). Thereafter, at steps S1203 and S1204, the measurement of the total numbers of printing pulses, nk, nc, nm and ny, and the measurement of the printing time t are started again. The preparatory discharge in the predetermined pattern in FIG. 12 may be the discharge described with reference to FIGS. 9 and 10. However, the preparatory discharge in any other pattern using a plurality of combinations of discharge orifice numbers than the combination of even-numbered discharge orifices and odd-numbered discharge orifices may be used as long as it performs discharge from all the discharge orifices. FIG. 13 shows a flowchart of another preparatory discharge.

In FIG. 13, the array of 256 discharge orifices is divided into s (s=4) groups, and discharge orifices having numbers obtained by (s×x−y)=(4×x−y) (x is integer up to 64 obtained by dividing the number of discharge orifices 256 by 4) (y=0), i.e., discharge orifices with numbers as multiples of 4 (L4, L8, L12, . . . ) are continuously driven K'1 times at the driving frequency 10 KHz (step S1301). Next, discharge orifices having numbers obtained by subtracting 1 from multiples of 4 (y=1) (L3, L7, L11, . . . ) are continuously driven K'2 times at the driving frequency 10 KHz (step S1302). Next, discharge orifices having numbers obtained by subtracting 2 from multiples of 4 (y=2) (L2, L6, L10, . . . ) are continuously driven K'3 times at the driving frequency 10 KHz (step S1303). Next, discharge orifices having numbers obtained by subtracting 3 from multiples of 4 (y=3) (L1, L5, L9, . . . ) are continuously driven K'4 times at the driving frequency 10 KHz (step S1304). These operations are repeated K'5 times, and discharge is not performed for a period of time for continuously driving the discharge orifices K'6 times at the driving frequency 10 KHz (step S1305). These operations are repeated K'7 times.

In black, cyan, magenta and yellow colors, the values from K'1 to K'4 are 128. The value of K'5 is 2, and the value of K'6 is 256. The value of K'7 for black is 8; for cyan, 12; for magenta, 14; and for yellow, 16. The value of K'7 increases depending on the relation among the critical values of the respective colors, in descending order, black, cyan, magenta and yellow.

Note that the values from K'1 to K'7 may be changed in accordance with the ink characteristics, the shape of the ink discharge orifices and the type of discharge energy generators.

As described above, the amount of residual bubbles and precipitate can be obtained more precisely by measuring the number of printing pulses and the printing time from the start to the end of printing and obtaining the number of printing pulses/printing time. Accordingly, regarding each ink type (color ink in the embodiment), only if the obtained value is equal to or greater than a predetermined value to cause discharge failure, preparatory discharge in a predetermined pattern for each color is performed to effectively discharge residual bubbles and the precipitate. This enables excellent image printing without unnecessarily increasing ink consumption and without reduction of the printing speed.

In the present embodiment, the amount of residual bubbles and that of precipitate are obtained more precisely by measuring the number of printing pulses and the printing time from the start to the end of printing and obtaining the number of printing pulses/printing time. However, the amount of residual bubbles and that of precipitate may be obtained by measuring the number (n) of printing pulses from the start to the end of printing and a printing area (w) and obtaining the number (n) of printing pulses/printing area (w). In this case, only if a predetermined value to cause discharge failure (d)≦the number (n) of printing pulses/printing area (w) and a predetermined value (e)≦the number (n) of printing pulses hold, preparatory discharge in a predetermined pattern is performed to effectively discharge the residual bubbles and the precipitate.

Further, in the present embodiment, it may be arranged such that the number of printing pulses per unit period, i.e., {the number of printing pulses/printing time}, and the number of printing pulses are obtained, each time a predetermined period of printing time has elapsed or the number of printing pulses has reached a predetermined value, and in each color, if the values are greater than two predetermined values of the color, preparatory discharge is performed in a predetermined pattern for the color. The two predetermined values may be determined in accordance with the conditions corresponding to the ink characteristic, the shape of ink discharge orifices and the type of discharge energy generators. More preferably, to enhance the effect of preparatory discharge, the driving frequency is lower than that for normal printing. Further, in the present embodiment, a printhead having an array of discharge orifices as shown in FIGS. 2 and 3 is used, however, similar advantages can be obtained by using a printhead having two rows of staggered discharge orifices as shown in FIGS. 4 and 5.

Third Embodiment

The printhead used in the discharge recovery processing according to a third embodiment is a printhead having two rows of staggered discharge orifices as shown in FIGS. 4 and 5. The printhead has 256 discharge orifices (the number L of discharge orifices=256), arranged at 1/600 inch intervals in the arrow B direction in FIG. 4 (e.g., the interval between the discharge orifices L1 and L2 along the arrow B direction is 1/600 inch), (i.e. 600 dpi printing pixel density). Further, the printing apparatus according to the third embodiment has four printheads for discharging black ink, cyan ink, magenta ink and yellow ink, respectively.

Figure 14:
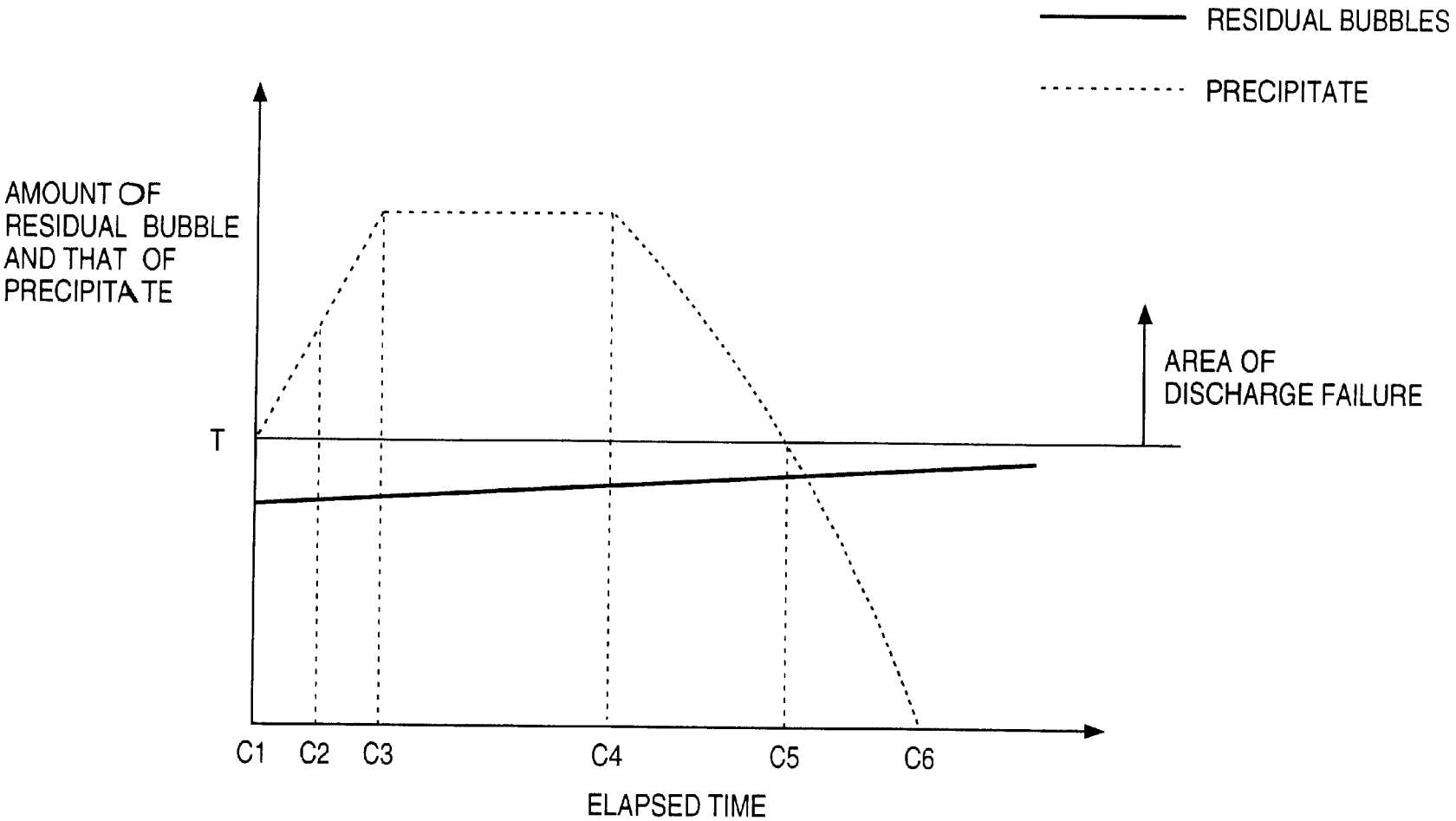
FIG. 14 is a graph explaining the relation between the amount of residual bubbles and that of the precipitate in the black ink, elapsed time.

FIG. 14 is a graph showing the result of measurement of the amount of residual bubbles and that of the precipitate and the time elapsed from the point where {the number of printing pulses/printing time} to cause discharge failure becomes the critical value "a1" with respect to the precipitate in the black ink in FIG. 7.

Figure 15:
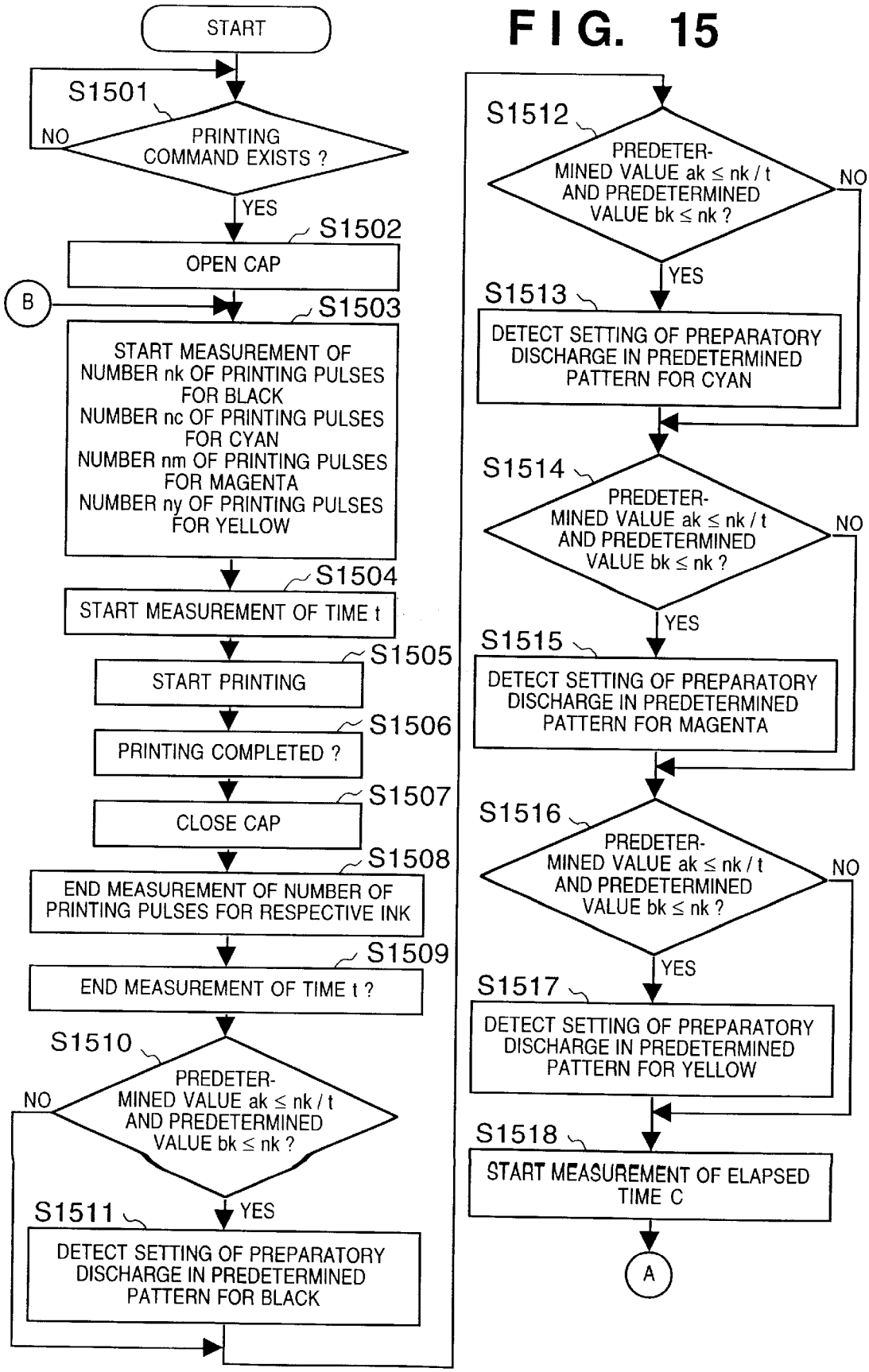
FIGS. 15 and 16 are flowcharts showing the discharge recovery processing according to a third embodiment of the present invention.

It is apparent from FIG. 15 that as the elapsed time increases, the amount of residual bubbles gradually increases. The amount of precipitate radically increases up to a point C3, but the amount does not change up to a point C4. From the point C4, the amount of precipitate decreases since the precipitate begins to be dissolved. At a point C6, the precipitate disappears. The other colors show similar tendencies. In comparison among the colors, the values from the point C1 to the point C6 increase in accordance with ink characteristics in descending order, yellow, magenta, cyan and black. Also, in the third embodiment, optimum discharge recovery processing is performed for the respective colors.

Figure 16:
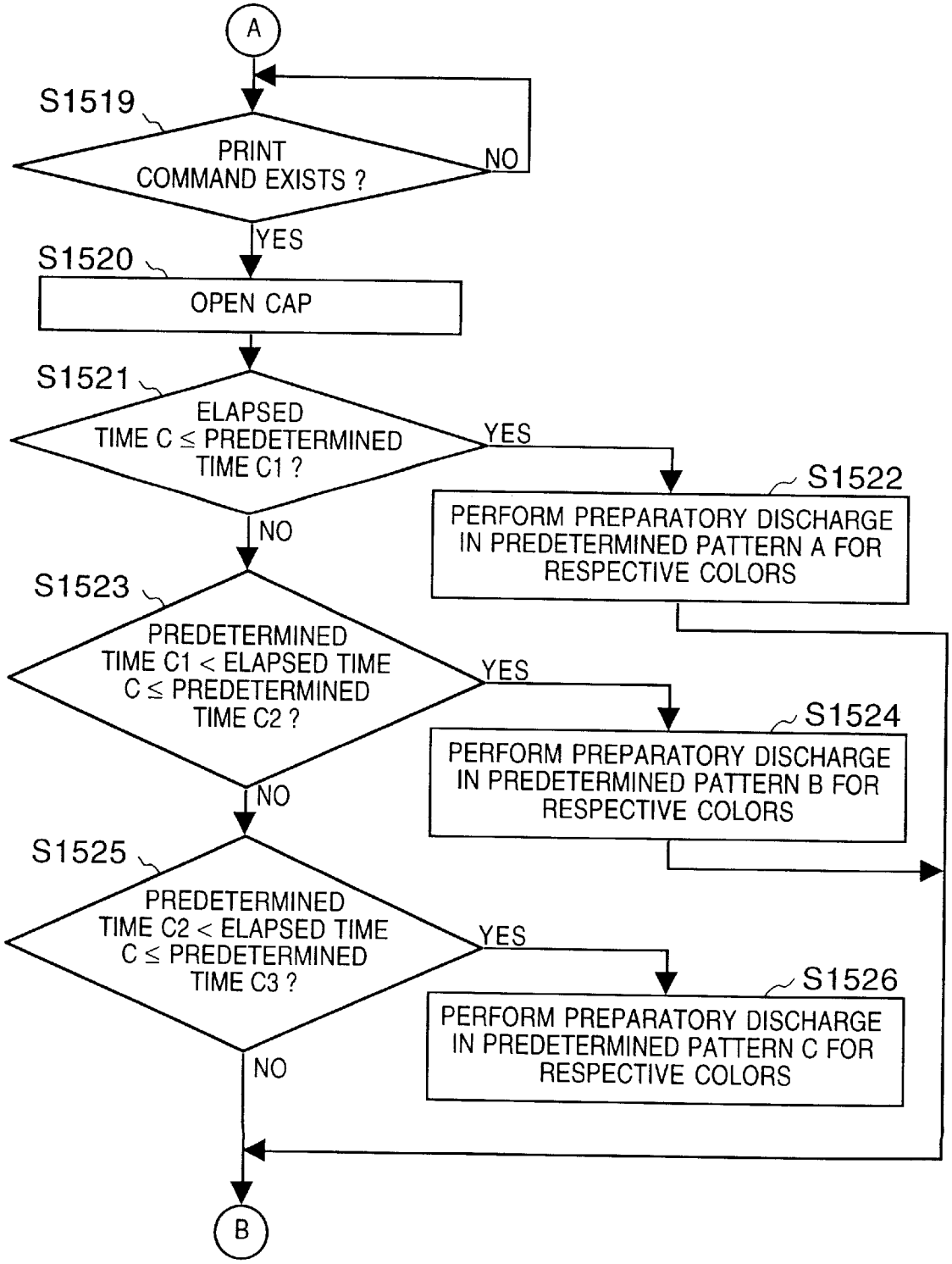

FIGS. 15 and 16 are flowcharts showing an example of the discharge recovery processing according to the third embodiment.

First, in the determination of existence/absence of printing command (step S1501), if no printing command exists, it is waited. If a printing command exists, the cap is opened (step S1502), the measurement of the total numbers of printing pulses from the 256 discharge orifices of the respective printheads, nk for black, nc for cyan, nm for magenta and ny for yellow, is started (step S1503). At the same time, the measurement of the printing time t is started (step S1504) and printing is started (step S1505).

If it is determined that the printing has been completed (step S1506), the cap is closed (step S1507). The measurement of the total numbers of pulses for respective color ink, nk, nc, nm and ny is terminated (step S1508) and the measurement of the printing time t is terminated (step S1509). Then, it is determined whether or not the number of printing pulses for black per 1 second as printing time, nk/t is equal to or greater than the predetermined value ak (ak=150000) which is less than the critical value a1 in FIG. 7 and whether or not the number nk of printing pulses for black is equal to or greater than the predetermined value bk (bk=30000000) which is less than the value b1 in FIG. 11 (step S1510). If ak≦nk/t and bk≦nk hold, setting of preparatory discharge in a predetermined pattern for black is detected (step S1511).

Similarly, it is determined whether or not the number of printing pulses for cyan per 1 second, nc/t is equal to or greater than the predetermined value ac (ac=100000) which is less than the predetermined value ak for black and whether or not the number nc of printing pulses for cyan (less than nk) is equal to or greater than a predetermined value bc (bc=24000000) (step S1512). If ac≦nc/t and bc≦nc hold, setting of preparatory discharge in a predetermined pattern for cyan is detected (step S1513).

Similarly, it is determined whether or not the number of printing pulses for magenta per 1 second, nm/t is equal to or greater than the predetermined value am (am=90000) which is less than the predetermined value ac for cyan and whether or not the number nm of printing pulses for magenta is equal to or greater than a predetermined value bm (bm=22000000) (step S1514). If am≦nm/t and bm≦nm hold, setting of preparatory discharge in a predetermined pattern for magenta is detected (step S1515). Similarly, it is determined whether or not the number of printing pulses for yellow per 1 second, ny/t is equal to or greater than the predetermined value ay (ay=80000) which is less than the predetermined value am for magenta and whether or not the number ny of printing pulses for yellow is equal to or greater than a predetermined value by (by=20000000) (step S1516). If ay≦ny/t and by≦ny hold, setting of preparatory discharge in a predetermined pattern for magenta is detected (step S1517). Then measurement of elapsed time C is started (step S1518). The process waits until it is determined that a printing command exists (step S1519).

If a printing command exists, the cap is opened (step S1520). The preparatory discharge is performed with different predetermined patterns for the respective colors in accordance with the elapsed time C. If the ROL elapsed time C≦a predetermined period of time C1=3 minutes holds (step S1521), preparatory discharge is performed in a predetermined pattern A for the respective colors (step S1522). If the predetermined time C1=3 minutes≦the elapsed time C≦a predetermined period of time C2=15 minutes holds (step S1523), preparatory discharge is performed in a predetermined pattern B for the respective colors (step S1524). If the predetermined time C2=15 minutes≦the elapsed time C≦a predetermined period of time C3=24 hours holds (step S1525), preparatory discharge is performed in a predetermined pattern C for the respective colors (step S1526). If the elapsed time C is equal to or longer than 24 hours (C3≧24 hours), the measurement of the total numbers of pulses, nk, nc, nm, ny from the 256 discharge orifices of the respective printheads is started again at step S1503 and the measurement of the printing time t is started again at step S1504.

Figure 9:
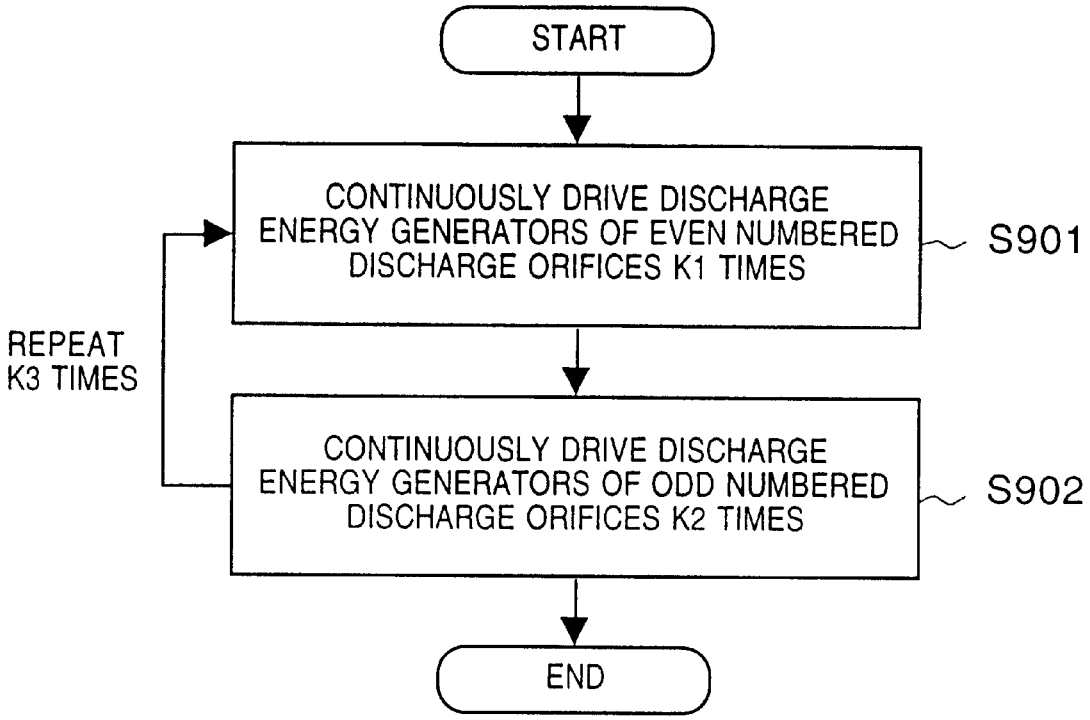
FIG. 9 is a flowchart for execution of preparatory discharge in a predetermined pattern according to the first embodiment.
Figure 10:
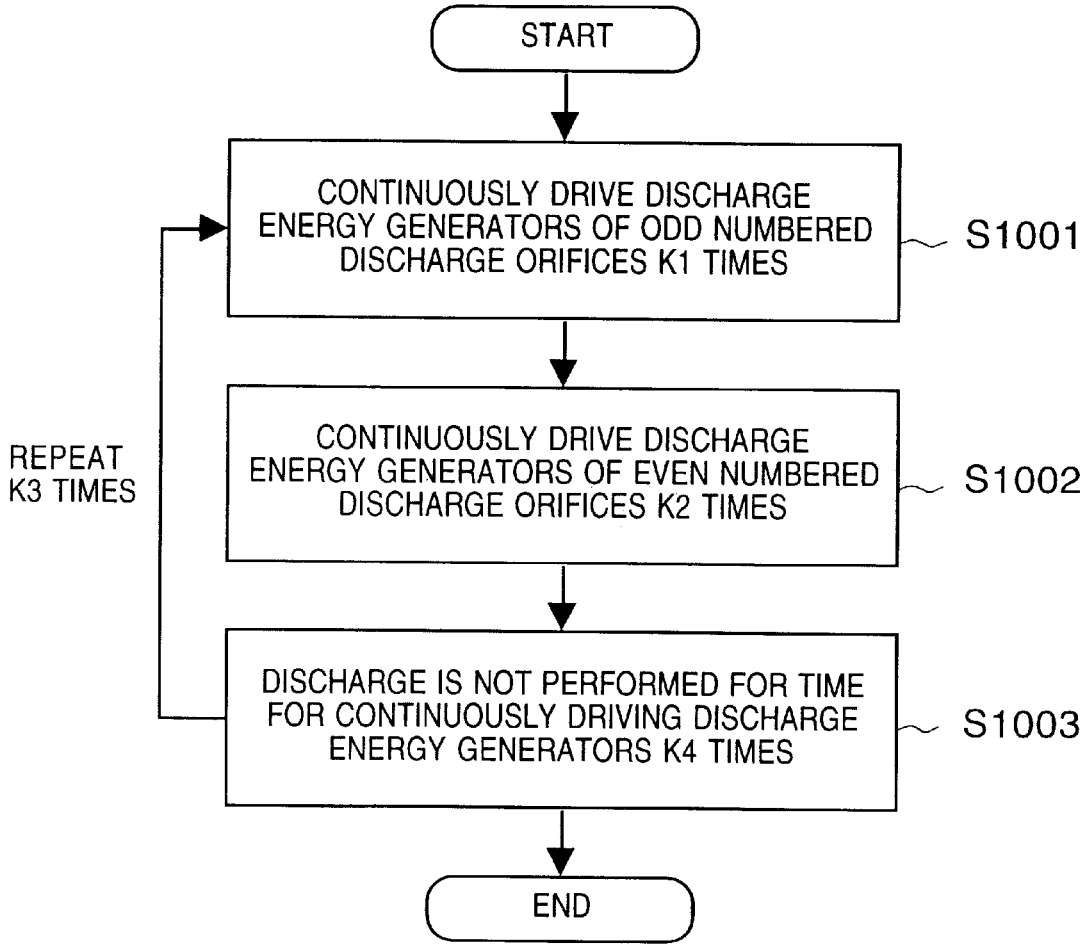
FIG. 10 is a flowchart for execution of preparatory discharge with another predetermined pattern according to the first embodiment.

The respective preparatory discharges in the predetermined patterns A, B and C may be performed in accordance with the flowcharts FIGS. 9 and 10 used in the first embodiment or FIG. 13 used in the second embodiment.

Further, in black ink, in the predetermined pattern A, the value of K3 in FIGS. 9 and 10 or K'7 in FIG. 13 is 6; in the predetermined pattern B, 12; in the predetermined pattern C, 18. In cyan, in the predetermined pattern A, the value is 10; in the predetermined pattern B, 20; and in the predetermined pattern C, 30. In magenta, in the predetermined pattern A, the value is 12; in the predetermined pattern B, 24; and in the predetermined pattern C, 36. In yellow, in the predetermined pattern A, the value is 14; in the predetermined pattern B, 28; and in the predetermined pattern C, 42. Thus, in each color, the total number of pulses in the predetermined pattern is increased in accordance with the elapsed time. Further, it may be arranged such that the preparatory discharge is performed in a pattern of different combinations of discharge orifice numbers. For example, the preparatory discharge may be performed in the predetermined pattern A in accordance with the flowchart of FIG. 9; in the predetermined pattern B in accordance with the flowchart of FIG. 10; and in the predetermined pattern C in accordance with the flowchart of FIG. 13. Since the effect of preparatory discharge is enhanced if the driving frequency is lower than that for printing, the driving frequency may preferably be changed in accordance with the predetermined patterns A, B and C.

As described above, in the first to third embodiments, the number of printing pulses and the printing time from the start to the end of printing are measured, and the number of printing pulses/printing time and the number of printing pulses are obtained. Only if it is determined that there is a high probability of occurrence of discharge failure, preparatory discharge in an optimum predetermined pattern in accordance with elapsed time is performed for the respective types of ink. This effectively discharges, removes or suppresses residual bubbles and a precipitate, and therefore, enables excellent image printing without unnecessarily increasing ink consumption and without reduction of the printing speed.

In the present embodiment, the amount of residual bubbles and that of precipitate are obtained by measuring the number of printing pulses and the printing time from the start to the end of printing and obtaining the number of printing pulses/printing time. However, the amount of residual bubbles and that of precipitate may be obtained by measuring the number (n) of printing pulses from the start to the end of printing and a printing area (w) and obtaining the number (n) of printing pulses/printing area (w). In this case, only if a predetermined value to cause discharge failure (d)≦the number (n) of printing pulses/printing area (w) and a predetermined value (e)≦the number (n) of printing pulses hold, preparatory discharge in a predetermined pattern is performed for respective types of ink, to effectively discharge the residual bubbles and precipitate.

Further, in the present embodiment, a printhead having two rows of staggered discharge orifices as shown in FIGS. 4 and 5 is used, however, similar advantages can be obtained by using a printhead having an array of discharge orifices as shown in FIGS. 2 and 3. Further, any arrangement of discharge orifices may be employed. Further, in the embodiments, the printing apparatus positively utilizes thermal energy, however, the present invention is not limited to this printing apparatus. Further, in the embodiments, there is no limitation on the environment for use of the printing apparatus, since the present invention is applicable to a printing apparatus connected to or incorporated in a copier or a host computer, or a printing apparatus incorporated into a facsimile apparatus or the like.

As described above, the present invention provides a printing apparatus which prevents discharge failure due to residual bubbles and a precipitate generated in accordance with a printing history of past printing including the number of printing pulses, the printing time and the printing area, and discharge failure due to residual bubbles coalesced into larger bubbles after the completion of printing and a precipitate from ink, further, which performs excellent image printing without unnecessarily increasing ink consumption and without reduction of the printing speed.

The present invention can be applied to a system constituted by a plurality of devices such as a host computer, an interface unit, printer etc., or to an apparatus comprising a single device such as a copier.

The present invention is not limited to the above embodiments and various changes and modifications can be made within the spirit and scope of the present invention. Therefore, to appraise the public of the scope of the present invention, the following claims are made.

What is claimed is:

1. An ink-jet printing apparatus using a printhead with a plurality of discharge orifices, including heat sources, for discharging ink droplets, comprising:

detection means for detecting a driving state of said printhead per unit period;

determination means for determining whether or not the driving state detected by said detection means has become a predetermined state; and control means for performing discharge recovery processing on said printhead if it is determined by said determination means that said printhead has entered said predetermined state.

2. The ink-jet printing apparatus according to claim 1, wherein said printhead is removable.

3. The ink-jet printing apparatus according to claim 1, wherein said detection means detects a number of drive to said plurality of discharge orifices of said printead per unit period.

4. The ink-jet printing apparatus according to claim 3, wherein said detection means detects the number of driving pulses per unit period.

5. The ink-jet printing apparatus according to claim 4, wherein if the number of driving pulses per unit period is equal to or greater than a predetermined threshold value, said determination means determines that said printhead has entered the predetermined state.

6. The ink-jet printing apparatus according to claim 5, wherein said determination means determines whether or not the number of driving pulses is equal to or greater than a predetermined number.

7. The ink-jet printing apparatus according to claim 5, wherein said determination means determines the number of driving pulses and the size of a printing area.

8. The ink-jet printing apparatus according to claim 5, wherein said predetermined threshold value is near and less than a critical value to cause discharge failure due to residual bubbles and/or a precipitate from ink.

9. The ink-jet printing apparatus according to claim 1, wherein said printhead has ink discharge orifices for ink of plural colors, and wherein said predetermined state differs depending on each color.

10. The ink-jet printing apparatus according to claim 1, wherein the discharge recovery processing controlled by said control means performs preliminary discharge from the discharge orifices of said printhead.

11. The ink-jet printing apparatus according to claim 10, wherein said preliminary discharge performs discharge by dispersedly driving an array of the plurality of discharge orifices.

12. The ink-jet printing apparatus according to claim 11, wherein a number of said preliminary discharge varies in accordance with elapsed time in said printhead.

13. The inkjet printing apparatus according to claim 12, wherein a driving interval in said preliminary discharge is longer than that in normal print processing.

14. A discharge recovery method for a printhead of an ink-jet printing apparatus, having a plurality of discharge orifices including heat sources, for discharging ink droplets, comprising:

a detection step of detecting a driving state of said printhead per unit period;

a determination step of determining whether or not the driving state detected at said detection step has become a predetermined state; and a control step of performing discharge recovery processing on said printhead if it is determined at said determination step that said printhead has entered said predetermined state.

15. An ink-jet printing apparatus using printheads, corresponding to the number of print color components, each printhead having a plurality of heat sources, for discharging ink droplets, said apparatus comprising:

detection means for detecting a driving state of each of said printheads for the respective color components per unit period;

determination means for determining whether or not the driving state of each of said printheads for the respective color components has become a state set in accordance with each print color; and control means for, if it is determined by said determination means that at least one of said printheads for the respective color components has entered the predetermined state, performing discharge recovery processing on said printhead.

16. The ink-jet printing apparatus according to claim 15, wherein said discharge recovery processing divides the discharge orifices of said printhead into a plurality of groups, and performs preliminary discharge a predetermined number of times on each group.

17. The ink-jet printing apparatus according to claim 16, wherein a driving interval in said preliminary discharge is longer than that in normal print precessing.

18. A discharge recovery method for printheads of an ink-jet printing apparatus, corresponding to the number of print color components each printhead having a plurality of heat sources, for discharging ink droplets, said method comprising:

a detection step of detecting a driving state of each of said printheads for the respective color components per unit period;

a determination step of determining whether or not the driving state of each of said printheads for the respective color components has become a state set in accordance with each print color; and a control step of, if it is determined at said determination step that at least one of said printheads for the respective color components has entered the predetermined state, performing discharge recovery processing on said printhead.

19. The discharge recovery method according to claim 18; wherein said discharge recovery processing divides the discharge orifices of said printhead into a plurality of groups, and performs preliminary discharge a predetermined number of times on each group.

20. The discharge recovery method according to claim 19, wherein a driving interval in said preliminary discharge is longer than that in normal print processig.

* * * * *

UNITED STATES PATENT AND TRADEMARK OFFICE

CERTIFICATE OF CORRECTION

PATENT NO. : 6,382,765 B1
DATED : May 7, 2002
INVENTOR(S) : Kanda et al.

It is certified that error appears in the above-identified patent and that said Letters Patent is hereby corrected as shown below:

Column 2,
Line 4, “suction-or” should read -- suction or --;
Line 24, “problem” should read -- problems --; and
Line 53, “in.” should read -- in --.

Column 3,
Line 33, “pulse” should read -- pulses --.

Column 4,
Line 4, “name” should be deleted; and
Line 43, “proessing” should read -- processing --.

Column 6,
Lines 46 to 59 should be deleted.

Column 7,
Line 66, “al” should read -- a1 --.

Column 8,
Line 2, “al” should read -- a1 --;
Line 55, “job.” should read -- jobs. --; and
Line 67, close-up left margin.

Column 9,
Line 48, “characteristic,” should read -- characteristics, --.

Column 10,
Line 54, “al” should read -- a1 --.

Column 12,
Line 39, “characteristic,” should read -- characteristics, --.

Column 15,
Line 43, “appraise” should read -- apprise --; and
Line 62, “drive” should read -- drives --.

Column 16,
Line 33, “inkjet” should read -- ink-jet --.

UNITED STATES PATENT AND TRADEMARK OFFICE

CERTIFICATE OF CORRECTION

PATENT NO. : 6,382,765 B1
DATED : May 7, 2002
INVENTOR(S) : Kanda et al.

It is certified that error appears in the above-identified patent and that said Letters Patent is hereby corrected as shown below:

Column 17,
Line 11, "components" should read -- components, --.

Signed and Sealed this

Twenty-second Day of April, 2003

JAMES E. ROGAN
*Director of the United States Patent and Trademark Office*